US008023861B2

(12) United States Patent
Yoshinaga et al.

(10) Patent No.: US 8,023,861 B2
(45) Date of Patent: Sep. 20, 2011

(54) FIXING DEVICE AND IMAGE-FORMING APPARATUS COMPRISING THE SAME

(75) Inventors: Hiroshi Yoshinaga, Chiba (JP); Masanao Ehara, Kanagawa (JP); Akira Shinshi, Tokyo (JP); Naoki Iwaya, Kanagawa (JP); Yoshiki Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 220 days.

(21) Appl. No.: 12/326,467

(22) Filed: Dec. 2, 2008

(65) Prior Publication Data

US 2009/0148204 A1 Jun. 11, 2009

(30) Foreign Application Priority Data

Dec. 11, 2007 (JP) ..... 2007-319946

(51) Int. Cl.
*G03G 15/16* (2006.01)

(52) U.S. Cl. ..... 399/122; 399/328

(58) Field of Classification Search ..... 399/122, 399/328

See application file for complete search history.

(56) References Cited

U.S. PATENT DOCUMENTS

| | | | | |
|---|---|---|---|---|
| 4,232,959 | A * | 11/1980 | Ateya et al. | 399/332 |
| 7,330,682 | B2 | 2/2008 | Shinshi | |
| 2002/0048713 | A1 * | 4/2002 | Komoto et al. | 399/331 |
| 2006/0002737 | A1 * | 1/2006 | Shinshi | 399/122 |
| 2007/0003334 | A1 | 1/2007 | Shinshi et al. | |
| 2007/0059003 | A1 | 3/2007 | Shinshi et al. | |
| 2007/0059071 | A1 | 3/2007 | Shinshi et al. | |
| 2007/0110464 | A1 | 5/2007 | Nakayama et al. | |
| 2007/0166085 | A1 | 7/2007 | Shinshi | |
| 2007/0292175 | A1 | 12/2007 | Shinshi | |
| 2009/0067902 | A1 * | 3/2009 | Yoshinaga et al. | 399/329 |

FOREIGN PATENT DOCUMENTS

| | | |
|---|---|---|
| JP | 5-173446 | 7/1993 |
| JP | 2000-214718 | 8/2000 |
| JP | 2001-318555 | 11/2001 |
| JP | 2002-202684 | 7/2002 |
| JP | 2006-48005 | 2/2006 |
| JP | 2007-78755 | 3/2007 |

* cited by examiner

*Primary Examiner* — Ryan Walsh

(74) *Attorney, Agent, or Firm* — Oblon, Spivak, McClelland, Maier & Neustadt, L.L.P.

(57) ABSTRACT

A fixing device and image-forming apparatus, which provide required glossiness and paper adaptability, and, in addition, feature good operability and excellent durability while achieving optimal pressure-applying force for a variety of requirements. The fixing device has a pressure-applying lever; a pressure-releasing lever; a locking member, the one end of which is rotationally attached to the pressure-releasing lever; and an elastic member which pulls the locking member in a locking direction. The configuration is such that the rotation of the pressure-releasing lever displaces the location of the locking member, thereby enabling switching between a pressure-applying position, in which a fixing member presses against another fixing member, and a pressure-releasing position, in which the one fixing member moves away from the other fixing member.

9 Claims, 15 Drawing Sheets

FIXING DEVICE AND IMAGE-FORMING APPARATUS COMPRISING THE SAME

BACKGROUND OF THE INVENTION

1. Field of the Invention

The present invention relates to a fixing device, which grips a recording medium on which a toner image has been formed between a pair of mutually opposed fixing members, and fixes the toner image to the recording medium by applying heat and/or pressure, and an image-forming apparatus comprising this fixing device.

2. Description of the Related Art

In an image-forming apparatus that utilizes a digital photography system, an electrostatic latent image is formed on the surface of a photosensitive drum, which is one example of an image carrier, this electrostatic latent image is made into a visible image by using a toner or the like, which is a developer, to develop the electrostatic image on the photosensitive drum, the developed image is transferred to a transfer material by a transfer device, the transfer material carries the image, and a fixing device fixes the toner image onto the transfer material using pressure and heat. This image-fixed transfer material passes through a paper discharge path and is discharged outside the apparatus. The fixing device grips the recording medium between a pair of opposing fixing members, for example, either rotating members such as rollers or belts, or fixed members such as pressure pads, or a combination thereof, and applies heat and/or pressure to fix the toner image onto the recording medium.

For example, a fixing roller equipped with a built in heater, which is heating means, and a pressure-applying lever, such as a pressure roller that makes contact with the fixing roller are arranged as the fixing members. A toner transfer agent-bearing recording medium that has reached the fixing device is introduced into a fixing nip, which constitutes the contact part of the fixing roller and pressure roller. In the process of the recording medium passing through the fixing nip, the transferred toner image is fixed to the surface of the recording medium by being subjected to heat and pressure.

However, when a paper jam creates a state in which the recording medium becomes stuck in the fixing nip of this fixing device and the apparatus stops, jam processing, in which the user removes this recording medium, is extremely difficult due to the fact that the recording medium is stuck in a state in which pressure is being applied to the fixing nip. For this reason, a method in which a manual release lever is provided in the fixing device prior to the user carrying out jam processing to release the pressure at the time of jam processing has been well known for some time now.

The problems with the manual method are the complicated nature of the lever operation and forgetting to operate the lever. Therefore, Japanese Patent Application Laid-open No. H5-173446 (hereinafter referred to as Prior Art 1) proposes an automatic release device, which uses a cam device to automatically release the contact pressure of the fixing nip.

Japanese Patent Application Laid-open No. 2001-318555 (hereinafter referred to as Prior Art 2) proposes a configuration which causes a cam attached to a release lever to act on a direct-pressure-applying lever to release the pressure-applying state of the fixing members.

Japanese Patent Application Laid-open No. 2000-214718 (hereafter referred to as Prior Art 3) proposes a configuration in which releasing the pressure-applying state of the fixing members is linked to the opening and closing of a cover.

The above-mentioned Prior Art 1 comprises a cam device for automatically releasing the contact pressure of the fixing nip, but this requires the disposition of a new drive mechanism such as a dedicated motor, increasing the weight and cost of the device. In recent years, it has been desirable to make image-forming apparatuses smaller and faster, and making the fixing rollers and belts smaller in diameter has resulted in shorter nips for holding the recording medium. On the other hand, since the speed at which the paper passes through has become faster, the heat applied to the recording medium at fixing is no longer sufficient, making it difficult to achieve satisfactory fixing performance. For this reason, a stronger pressure-applying force is needed than in conventional devices so as to ensure a bigger nip. The problem with this is that the actuating force on the conventional manual release lever becomes too great, making it difficult for the user to operate.

Further, in the case of a configuration which causes a cam attached to a release lever to act on a direct-pressure-applying lever to release the pressure-applying state of the fixing members as disclosed in the above-mentioned Prior Art 2, the problem is that strengthening the pressure-applying force increases the frictional force between the cam and the direct-pressure-applying lever, thereby lowering the sliding performance of the sliding contact surface, and also increasing the wear on the sliding contact surface.

Even when the release of the pressure-applying state of the fixing members is linked to the opening and closing of a cover as disclosed in the above-mentioned Prior Art 3, the problem is that strengthening the pressure-applying force increases the frictional force of the contact surfaces of the release lever and opening-and-closing cover, lowering the sliding performance of the sliding contact surfaces and increasing the mutual wear on the sliding contact surfaces.

To solve for problems such as those mentioned above, Japanese Patent Application Laid-open No. 2006-48005 (hereinafter referred to as Prior Art 4), which discloses a fixing device that features good operability and excellent durability while producing favorable pressure-applying force, is known. In the configuration of this Prior Art 4, a fixing device, which fixes a toner image onto a recording medium by gripping the recording medium between a pair of opposing fixing members and applying heat and/or pressure, has a pressure-applying lever for causing the one fixing member to apply pressure to the other fixing member; a pressure-releasing lever, which is rotatably supported on the pressure-applying lever; a locking member, one end of which is rotatably attached to the pressure-releasing lever; and an elastic member, which is latched to the other end of the locking member, and pulls the locking member in the locking direction, and is characterized in that the rotation of the pressure-releasing lever displaces the location of the locking member, enabling a pressure-applying position, in which the one fixing member presses against the other fixing member via the pressure-applying lever, to switch over to a pressure-releasing position, in which the one fixing member moves away from the other fixing member, and in the pressure-applying position, the pressure-applying lever and the locking member, which are fastened together at a location at the opposite end of the rotating central shaft of the pressure-applying lever, are pulled in the locking direction by the elastic member.

In accordance with this configuration, a pressure-releasing lever is rotatably supported on a pressure-applying lever that causes the one fixing member to apply pressure to the other fixing member, one end of a locking member is rotatably attached to this pressure-releasing lever, and an elastic member, which pulls the locking member in the locking direction, is latched to the other end of the locking member, and when the pressure-releasing lever rotates, the location of the locking member is displaced, and a pressure-applying position, in which the one fixing member presses against the other fixing member via the pressure-applying lever, is switched over to a pressure-releasing position, in which the one fixing member moves away from the other fixing member. Thus, this configuration does not have a cam or driving means for driving the cam as in the past, and can be made lightweight and inexpensive. Since the rotation of the pressure-releasing lever also displaces the location of the locking member to which the elastic member is latched to one end, elastic means extension is minimal and the actuating force at operation is small, making user operation easy. Since the pressure-applying lever and the locking member are fastened together at the furthest location from the rotating central shaft of the pressure-applying lever, and the elastic member pulls thereon, the part that slides over the locking member can be subjected to minimal frictional force, achieving high durability.

However, in recent years, the glossiness required for an output image has come to differ by the application and type of paper of the recording medium, and fixability for a variety of recording media is required.

SUMMARY OF THE INVENTION

It is a first object of the present invention to provide a fixing device and image-forming apparatus, which provide the required glossiness and paper adaptability, and, in addition, feature good operability and excellent durability while achieving optimal pressure-applying force for a variety of requirements.

It is a second object of the present invention to provide a fixing device and image-forming apparatus that can be easily operated by a user.

In an aspect of the present invention, a fixing device uses a pair of opposing fixing members to grip a recording medium, and fixes a toner image onto the recording medium by applying heat and/or pressure. The fixing device comprises a pressure-applying lever for causing one of the pair of fixing members to apply pressure to the other one of the pair of fixing members; a pressure-releasing lever that is rotationally supported on the pressure-applying lever; a locking member, which has one end rotationally attached to the pressure-releasing lever; and an elastic member, which engages with the other end of the locking member, and which pulls the locking member in a locking direction. The rotation of the pressure-releasing lever displaces the location of the locking member, thereby enabling switching between a pressure-applying position, in which one of the pair of fixing members presses against the other one of the pair of fixing members via the pressure-applying lever, and a pressure-releasing position, in which one of the pair of fixing members moves away from the other one of the pair of fixing members. At the pressure-applying position, the pressure-applying lever and the locking member, which are fastened together at a location at one end of the pressure-applying lever opposite a rotation central shaft thereof, are pulled in the locking direction by the elastic member, and a support-point location of the pressure-applying lever is changed to vary the pressure for gripping the recording medium between the pair of fixing members.

In another aspect of the present invention, a fixing device uses a pair of opposing fixing members to grip a recording medium, and fixes a toner image onto the recording medium by applying heat and/or pressure. The fixing device comprises a pressure-applying lever for causing one of the pair of fixing members to apply pressure to the other one of the pair of fixing members; a pressure-releasing lever that is rotationally supported on the pressure-applying lever; a locking member, which has one end rotationally attached to the pressure-releasing lever; and an elastic member, which engages with the other end of the locking member, and which pulls the locking member in a locking direction. The rotation of the pressure-releasing lever displaces the location of the locking member, thereby enabling switching between a pressure-applying position, in which one of the pair of fixing members presses against the other one of the pair of fixing members via the pressure-applying lever, and a pressure-releasing position, in which one of the pair of fixing members moves away from the other one of the pair of fixing members. At the pressure-applying position, the pressure-applying lever and the locking member, which are fastened together at a location at one end of the pressure-applying lever opposite a rotation central shaft thereof, are pulled in the locking direction by the elastic member, and the pressure-applying position of the pressed fixing member to be pressed and the pressure-applying lever is changed to vary the pressure for gripping the recording medium between the pair of fixing members.

In another aspect of the present invention, an image-forming apparatus comprises an image carrier for forming a latent image; an charging device for applying a uniform electrical charge to a surface of the image carrier; an exposure device for exposing and writing a latent image to the charged surface of the image carrier based on image data; a developing device for supplying toner to the latent image formed on the surface of the image carrier to make this image visible; a cleaning device for bringing a blade into contact with the surface of the image carrier to remove residual toner; a transfer device for transferring the visible image on the surface of the image carrier to a recording medium either directly or after having transferred this image to an intermediate transfer body; and a fixing device, which uses a pair of opposing fixing members to grip the recording medium, and which fixes a toner image onto the recording medium by applying heat and/or pressure. The fixing device comprises a pressure-applying lever for causing one of the pair of fixing members to apply pressure to the other one of the pair of fixing members; a pressure-releasing lever that is rotationally supported on the pressure-applying lever; a locking member, which has one end rotationally attached to the pressure-releasing lever; and an elastic member, which engages with the other end of the locking member, and which pulls the locking member in a locking direction. The rotation of the pressure-releasing lever displaces the location of the locking member, thereby enabling switching between a pressure-applying position, in which one of the pair of fixing members presses against the other one of the pair of fixing members via the pressure-applying lever, and a pressure-releasing position, in which one of the pair of fixing members moves away from the other one of the pair of fixing members. At the pressure-applying position, the pressure-applying lever and the locking member, which are fastened together at a location at one end of the pressure-applying lever opposite a rotation central shaft thereof, are pulled in the locking direction by the elastic member. A support-point location of the pressure-applying lever is changed to vary the pressure for gripping the recording medium between the pair of fixing members, and a cover, which is supported on a main body of the image-forming apparatus is engaged with one end of the pressure-releasing lever in a freely opening and closing manner, thereby causing the pressure-releasing lever to rotate as the result of the opening and closing operation of the cover.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(s)

The present invention will be explained hereinbelow by referring to the figures.

Figure 1:
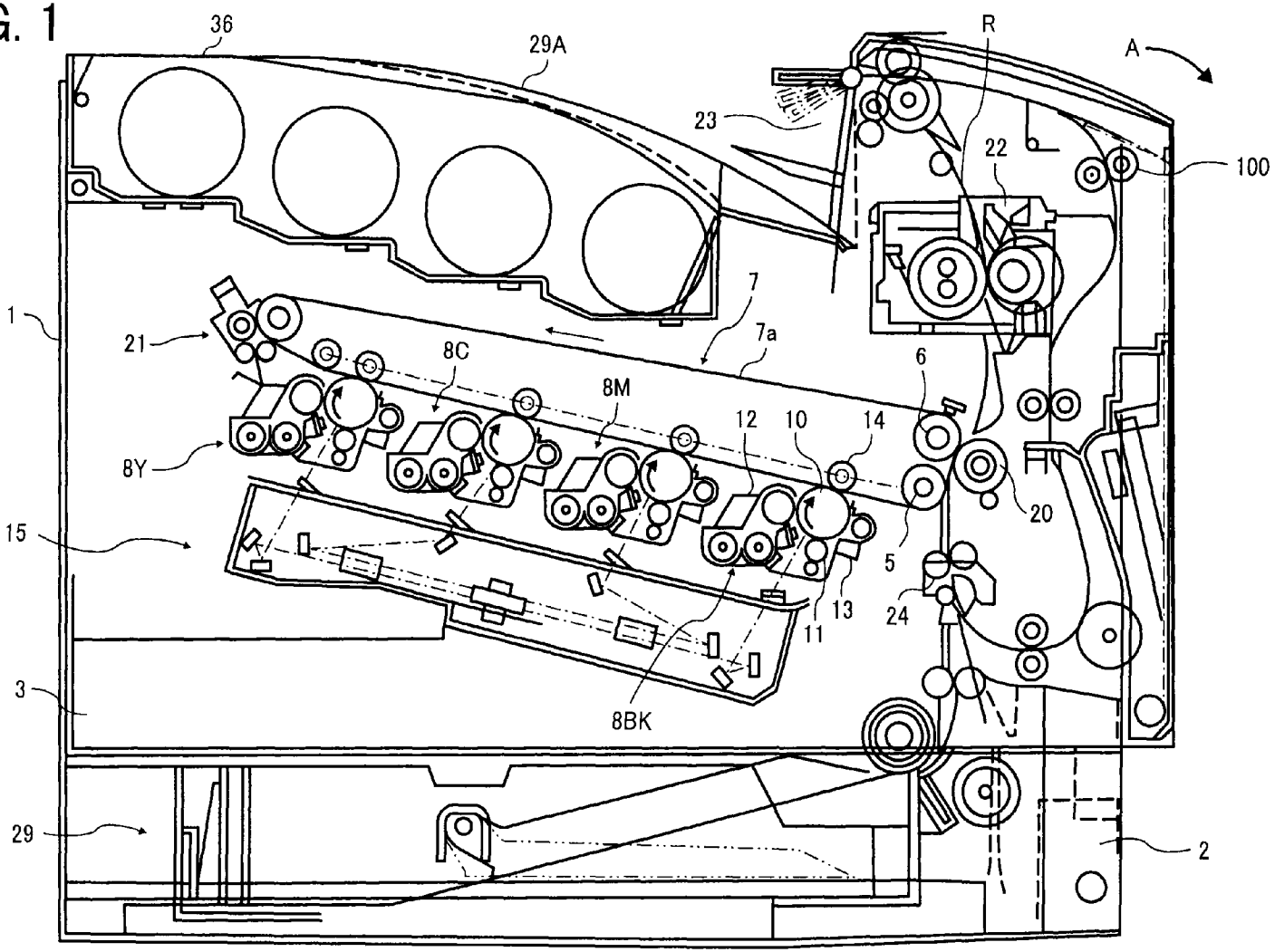
FIG. 1 is a diagram showing the approximate configuration of a color printer, in which an image-forming apparatus of the present invention can be employed in tandem with a digital photography system to form a full-color image.

FIG. 1 shows the approximate configuration of a color printer (hereinafter called the "printer"), in which an image-forming apparatus of the present invention can be used in tandem with a digital photography system to form a full-color image. The image-forming apparatus is not limited to the printer shown in FIG. 1, but rather can also be a copier, a facsimile machine or the like.

Referring to FIG. 1 of the drawings, the basic configuration of this printer and the operation thereof will be explained, and thereafter, the configuration and operation peculiar to the present invention will be explained.

This printer constitutes a configuration in which a paper feeding cassette 2, in which paper 29 that serves as the recording medium is stored, is arranged below the image-forming apparatus main unit 1, which constitutes the basis of the printer, and an image-forming part 3 is arranged thereabove. In the image-forming part 3, there are disposed an image creating part 8, which comprises four image creating units 8Y, 8C, 8M, 8BK that serve as a plurality of image creating means comprising image carriers; a plurality of rollers 4, 5, 6; an intermediate transfer unit 7, which has an intermediate transfer belt 7A serving as an intermediate transfer body that is configured from a flexible endless belt that is wrapped around these rollers; an optical writing unit 15 as an optical writing part for carrying out optical writing on the respective image carriers; and fixing means 22 for fixing a toner image to a piece of paper 29. The image creating units 8Y, 8C, 8M, 8BK and the intermediate transfer unit 7 are replaceably mounted in the apparatus main unit 1. A transport path R for transporting the paper 29 is formed between the paper feeding part 2 and fixing means 22. Roller 6 is arranged facing the transport path R. In this embodiment, the intermediate transfer unit 7, image creating part 8, optical writing unit 15 and fixing means 22 constitute the components in the inside of the image-forming apparatus, and are arranged in the approximate center of the inside of the apparatus main unit 1.

The portion of the intermediate transfer belt 7*a* between roller 4 and roller 5 corresponds to the lower belt travel side of this belt. A secondary transfer roller 20, which constitutes a secondary transfer device, is disposed on the intermediate transfer belt 7*a* at a location opposite roller 6 so as to face the transport path R, and a belt cleaning device 21 for cleaning the surface of the belt is disposed on the intermediate transfer belt 7*a* at a location opposite roller 4.

The image creating part 8 is disposed beneath the intermediate transfer belt 7*a* by being arranged so as to oppose the lower traveling side thereof. The respective image creating units each comprises a photosensitive drum 10 that serves as the image carrier that comes in contact with the intermediate transfer belt 7*a*. A charging device 11, developing device 12 and a cleaning device 13 are respectively arranged around the respective photosensitive drums 10. Transfer rollers 14 that serve as transfer means for carrying out primary transfer are respectively disposed on the inner side of the intermediate transfer belt 7*a* in locations where the respective photosensitive drums 10 come in contact with the intermediate transfer belt 7*a*.

In this embodiment, the image creating units 8Y, 8C, 8M, 8BK are basically configured in the same structure, and in FIG. 1, reference numerals are representatively assigned only to the configuration of image creating unit 8BK. The only difference among the respective image creating units is the color of the toner that serves as the developer stored in the respective development devices 12. In the respective development devices 12 of the image creating units 8Y, 8C, 8M, 8BK there is respectively stored yellow, cyan, magenta and black toners. When the toner in the respective development devices 12 runs low, refill toner is respectively supplied from toner refill bottles T1, T2, T3 and T4 installed in the upper part of the apparatus main unit 1.

The optical writing unit 15 irradiates a coherent laser beam L onto the surface of the respective photosensitive drums to form a latent image for each color on the photosensitive surface, and in this embodiment, is arranged below the image creating part 8.

The toner refill bottles T1, T2, T3, T4, intermediate transfer unit 7, image creating part 8, and optical writing unit 15 are disposed diagonally in the same direction inside the apparatus main unit 1, reducing the installation area thereof more than when these components are arranged horizontally inside the apparatus main unit 1.

When an image-forming operation commences, the respective photosensitive drums 10 of the image creating unit 8 are rotationally driven in the clockwise direction by a drive device not shown in the figure, and the surfaces of the respective photosensitive drums are uniformly charged to a prescribed polarity by the charging devices 11. Laser beams L are respectively irradiated from the optical writing unit 15 onto the respective surfaces of the electrically charged photosensitive drums, forming an electrostatic latent image on each surface. The image information exposed onto the respective photosensitive drums at this time is monochromatic imaging information that breaks down the desired full-color image into yellow, cyan, magenta and black color information. When the thus-formed electrostatic latent images pass between the respective photosensitive drums and development devices 12, these electrostatic latent images are made into visible images as toner images by the toners in the respective development devices 12.

One roller, of the plurality of rollers 4, 5, 6 around which the intermediate transfer belt 7*a* is wrapped, is rotationally driven in the counterclockwise direction by a drive device not shown in the figure, and the intermediate transfer belt 7*a* is consequently driven in a travelling manner in the counterclockwise direction indicated by the arrow, and the other rollers are rotated in a driven manner. A yellow toner image formed by image creating unit 8Y, which comprises a development device 12 having yellow toner, is transferred by the transfer roller 14 as the intermediate transfer belt 7*a* is traveling like this. A cyan toner image, a magenta toner image and a black toner image, which have been formed by the image creating units 8C, 8M, 8BK, are sequentially superposingly transferred by the transfer roller 14 onto this transferred yellow toner image, and, in this way, the intermediate transfer belt 7*a* carries a full-color toner image on the surface thereof.

Residual toner adhering to the surfaces of the respective photosensitive drums after the toner images have been transferred is removed from the surfaces of the photosensitive drums by the respective cleaning devices 13, these surfaces are subsequently subjected to discharge operations by discharging devices not shown in the figure, and the surface potentials thereof are initialized in preparation for the next image to be formed. The paper 29 fed from the paper feeding part 2 is sent into the transport path R, the paper feeding timing is measured by a pair of resistance rollers 24 installed on the paper feeding side of the secondary transfer roller 20, and the paper 29 is supplied to the opposing parts of roller 6 and secondary transfer roller 20. Then, at this time, a transfer voltage having a reverse polarity from that of the polarity of the toner charge of the toner image on the surface of the intermediate transfer belt is applied to the secondary transfer roller 20, and the toner image on the surface of the intermediate transfer belt 7*a* is consequently collectively transferred onto the paper 29. The paper 29 onto which the toner image has been transferred is transported to fixing means 22, and upon passing through fixing means 22, the toner image is fused and fixed by being subjected to heat and pressure. The printed matter 29 on which the toner image has been fixed is transported to a discharging part 23, which is configured in the upper portion of the apparatus main unit 1 located at the end of the transport path R, and discharged to a loading part 36, which is configured on top of the apparatus main unit 1. Residual toner on the intermediate transfer belt 7*a* subsequent to the toner image having been transferred to the paper 29 is removed by the cleaning device 21.

Since a printer configured like this disposes four image creating units 8Y, 8C, 8M, 8BK facing the intermediate transfer belt 7*a*, and toner images of the respective colors are sequentially superposingly transferred to the intermediate transfer belt 7*a*, one image creating means can hold development devices of four colors and superposingly transfer the toner image onto the intermediate transfer belt, thereby making it possible to greatly shorten image creation time compared to a printer configured to transfer the toner image to the paper thereafter. Further, since a loading part 36 is configured on top of the apparatus main unit 1, the loading part 36 does not protrude circumferentially from the apparatus main unit 1, thereby reducing the installation area and occupied area. The above explanation described an image-forming operation when a full-color image is formed on a piece of paper 29, but it is also possible to form a monochromatic image by using any one of the image creating units of the image creating part 8, and to form a two- or three-color image. Further, when monochromatic printing is carried out using the printer of this embodiment, an electrostatic latent image can be formed only on the photosensitive drum of image creating unit 8BK, developed and transferred to a piece of paper 29 via the same unit, and fixed by fixing means 22.

A characteristic configuration of the present invention will be explained next. A cover 100 is mounted to the image-forming apparatus main unit 1 in proximity to where the fixing device 22 is disposed so as to freely open-and-close around a point of support 101 relative to the image-forming apparatus main unit. FIG. 1 shows a state in which the cover 100 is closed. When this cover 100 is moved in the opening direction indicated by arrow A, the area around the fixing device 22 is exposed to the outside of the image-forming apparatus 1. One part of the fixing device 22 is configured such that, when the cover 100 is opened and closed, this part moves in conjunction with this operation as will be described hereinbelow.

Figure 2A:
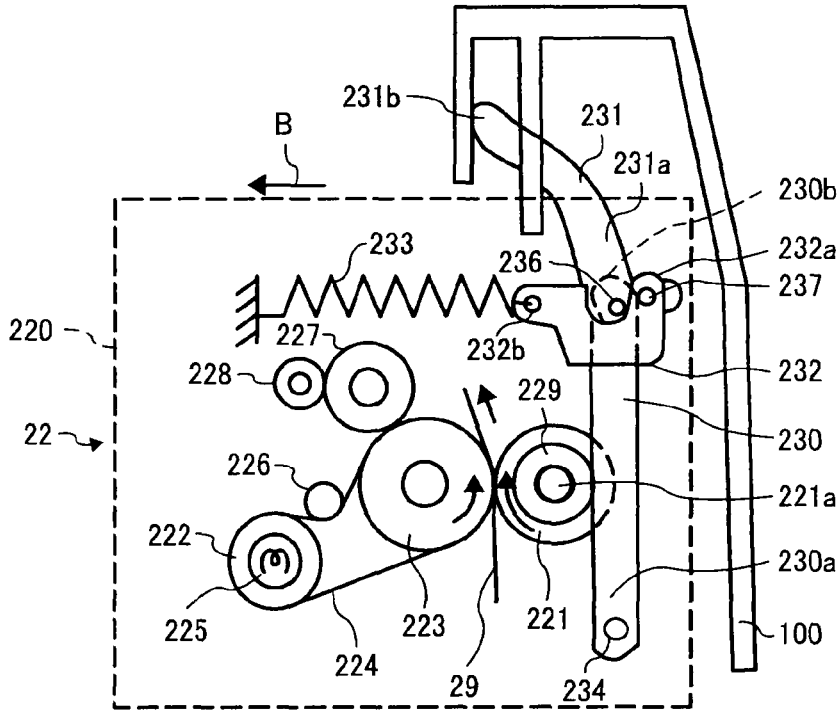
FIGS. 2A and 2B are diagrams showing the approximate configuration of a fixing device of one embodiment of the present invention.
Figure 2B:
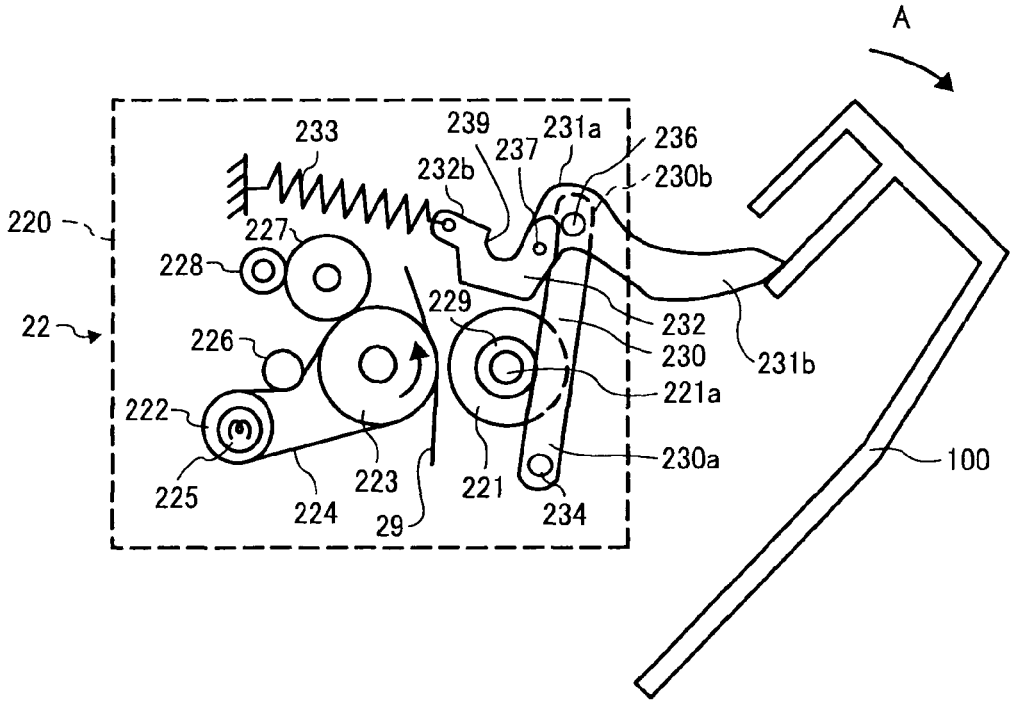

FIGS. 2A and 2B show the approximate configuration of a fixing device of an embodiment of the present invention.

The fixing device 22 related to the embodiment, as shown in FIG. 2A, is configured such that a pressure roller 221 that makes up one side of a pair of opposing fixing members, and a fixing belt 224, which serves as a belt member wrapped around a pair of rollers 222, 223 that configure the other side of the fixing member, face each other in the center of an enclosure 220 of the fixing device 22. Roller 222 has on the inside thereof a heating source 225 that is connected to a not-shown power source, and functions as a heat roller. Roller 223 is configured as a drive roller, which is rotationally driven by a not-shown drive motor. These rollers 222, 223 are rotatably supported by a not-shown side plate. Rollers 222, 223 and fixing belt 224 rotate in the counterclockwise direction in FIG. 2A, and pressure roller 221 is rotationally driven in the clockwise direction by making contact with the fixing belt 224.

Furthermore, an explanation will be given here using a fixing device 22 that has a fixing belt 224, but the fixing device 22 can also be a pair of fixing rollers that do not use a belt.

The pressure roller 221 is formed by disposing an elastic layer of silicon rubber or the like on top of either a metal core of aluminum, iron or the like, and the surface layer thereof constitutes a releasing layer configured from PFA (Tetra fluoro ethylene-perfluoro alkylvinyl ether copolymer) or PTFE (poly tetra fluoro ethylene). The end part 221*a* of the pressure roller metal core is rotatably supported by a bearing 229. This bearing 229 is supported by a not-shown side plate that is able to move in directions that make the pressure roller 221 come in contact with/separate from roller 223, and is configured such that the surface of the pressure roller 221 presses against/releases the fixing belt 224.

This embodiment uses a halogen heater as the heating source 225, and heats the heating roller 222, which is a non-heating member, and which constitutes a heating cycle member, and the fixing belt 224, but, for example, the heat roller 222 and fixing belt 224 can also be heated using an induction heating scheme like that disclosed in Japanese Patent Application Laid-open No. 2001-242732 and Japanese Patent Application Laid-open No. 2001-13805. The power for the heating source 225 generally comes from a commercial power source (100 V), but the configuration can be such that an auxiliary power source is provided to this commercial power source, and electric power is supplied from this auxiliary power source. As an auxiliary power source, it is preferable that an electrical double layer capacitor (an electrochemical capacitor) like that disclosed in Japanese Patent Application Laid-open No. 2002-174988 be used. In this embodiment, the heat roller is used as the heating cycle member, but an endless belt-shaped member like that disclosed in Japanese Patent Application Laid-open No. H11-232307 and Japanese Patent Application Laid-open No. 2001-66933 can also be used.

In FIG. 2A, reference numeral 226 shows a belt-tension roller, reference numeral 227 shows a belt cleaning roller, and reference numeral 228 shows a cleaning brush, respectively, and in this embodiment, tension is applied to the fixing belt 244 from the outside, but the belt-tension roller 226 can also apply tension by being arranged on the inner side of the fixing belt 224.

The fixing device 22 comprises a pressure-applying lever 230 for making the pressure roller 221 apply pressure to the fixing belt 224; a pressure-releasing lever 231, which is rotatably supported by the pressure-applying lever 230; a locking member 232, the one end 232*a* of which is rotatably attached to the pressure-releasing lever 231; and a tension coil spring 233 as an elastic member, which is latched to the other end 232*b* of the locking member 232, and which pulls the locking member 232 in the locking direction indicated by arrow B. Then, the configuration is such that the rotation of the pressure-releasing lever 231 makes it possible to switch the position of the locking member 232 from a pressure-applying position, in which pressure is applied via the pressure-applying lever 230 so that the pressure roller 221 presses against the fixing belt 224, to a pressure-releasing position, in which the pressure roller 221 moves away from the fixing belt 224. That is, the bottom end 230*a* of the pressure-applying lever 230, which constitutes the one end, is rotatably supported by a shaft 234 in a not-shown side plate. The base-end side 231*a* of the pressure-releasing lever 231 is rotatably supported by a shaft 236 in the top end 230*b*, which constitutes the other end of this pressure-applying lever 230.

The configuration is such that, when the cover 100 undergoes an open-and-close operation between the closed state shown in FIG. 2A and the open state shown in FIG. 2B, the tip-end side 231*b* of the pressure-releasing lever 231 engages with the inside of the cover while making sliding-contact and moves in synch with the open-and-close operation of the cover 100.

The one end 232*a* of the locking member 232 is rotatably supported by a shaft 237 in the base-end side 231*a* of the pressure-releasing lever 231. The configuration is such that, when the locking member 232 moves from the locking position shown in FIG. 2A to the release position shown in FIG. 2B, this shaft 237 is positioned so as to respectively move to both sides of shaft 236, which constitutes the hinge part of the pressure-releasing lever 231. In this embodiment, when the pressure-releasing lever 231 is in the lock position shown in FIG. 2A, shaft 237 is arranged on the opposite side of the other end 232*b* of the locking member 232 in relation to shaft 236, and when the pressure-releasing lever 231 is in the release position shown in FIG. 2B, shaft 237 is arranged on the same side as the other end 232*b* of the locking member in relation to shaft 236. A concave part 239 is formed when the pressure-releasing lever 231 is in the pressure-applying position between the one end 232*a* and the other end 232*b* of the locking member as shown in FIG. 2A, shaft 236 enters this concave part 239 and holds the locking member 232 and pressure-applying lever 230 in the lock position, and when the pressure-releasing lever 231 is in the release position shown in FIG. 2B, shaft 236 disengages from this concave part 239 and releases the locking member 232 and the pressure-applying lever 230 from the lock position. In this embodiment, since the pressure-releasing lever 231 moves upwards from the locking member 232 when moving counterclockwise around the shaft 236 in FIGS. 2A and 2B, the concave part 239 is formed such that the opening thereof is positioned in the locking member 232 facing upwards. The concave part 239 is formed in a location in which the shaft 236 is held practically directly above the pressure-applying lever 230 when the shaft 236 has entered into the concave part 239.

According to a configuration like this, when the cover 100 moves from the closed state shown in FIG. 2A to the open state shown in FIG. 2B, the tip-end side 231*b* is pressed against the cover 100, and the pressure-releasing lever 231 rotates in the clockwise direction around shaft 236. In line with this rotation, the locking member 232, which is rotatably supported by shaft 237 in the pressure-releasing lever 231, rotates as shaft 237 is lowered. In so doing, shaft 236, which had entered into the concave part 239, disengages from the concave part 239. Thus, the locking member 232 is pulled by the tension coil spring 233, shaft 237 moves to the left of shaft 236 in the figure, to the same side as the other end 232*b* of the locking member 232, that is, the shaft 237 approaches the side of the tension coil spring 233, and this spring 233 returns to its natural length. When the locking member 232 moves and is located on the other end 232*b* side from shaft 236, since the tensile strength of the tension coil spring 233 acts on the pressure-releasing lever 231 and the weight of the cover 100 is applied, the pressure-applying lever 230 moves around shaft 234 in the drop-down direction of the cover 100. Thus, the pressure on the pressure roller 221 is released.

Conversely, when the cover 100 moves from the open state shown in FIG. 2B to the closed state shown in FIG. 2A, the tip-end side 231*b* is pressed against the cover 100, and the pressure-releasing lever 231 and pressure-applying lever 230 move in the pressure-applying direction (to the left side in the figure), causing the pressure roller 221 to make pressure contact with the fixing belt 224. Since the movement of the pressure-applying lever 230 is controlled when the pressure roller 221 and fixing belt 224 make contact, the pressure-releasing lever 231 rotates around the shaft 236 in the counterclockwise direction. In line with this rotation, the locking member 232, which is rotatably supported by the shaft 237 in the pressure-releasing lever 231, moves to the right side of the figure while rotating around the shaft 236 against the spring force of the tension coil spring 233. When the movement of the pressure-releasing lever 231 in the closing direction progresses further, the shaft 236 enters into the concave part 239, the movement of the pressure-releasing lever 231 is controlled, and, in addition, the spring force of the tension coil spring 233 acts on the locking member 232, biasing the locking member 232 in the locking direction B. Thus, the pressure-releasing lever 231 is held in the lock position, and a state of pressure is maintained on the pressure roller 221 and fixing belt 224.

At this time, the pressure-applying lever 230 and locking member 232 interfit at the furthest location from the rotating central shaft 234 of the pressure-applying lever 230, and the pressure-applying lever 230 and locking member 232 are pulled in the locking direction B by the spring force of the tension coil spring 233. In this case, since the locking member 232 is in a location furthest from this shaft 234, the "principle of leverage" dictates that the force can be less than that when the locking member 232 is located close to the rotating central shaft 234 of the pressure-applying lever 230, and therefore, the force incurred when the shaft 236 moves over top of the locking member 232 is also small.

Thus, in this embodiment, since the pressure-applying state between the pressure roller 221 and the fixing belt 224 is released without using a motor or other such external drive device as in a conventional configuration, weight and costs can be reduced. Since the pressure-applying lever 230 and the locking member 232 interfit at the furthest location from the rotating central shaft 234 of the pressure-applying lever 230, and the tension coil spring 233 pulls thereon, it is possible to minimize the frictional force when the shaft 236 slides on top of the locking member 232, thereby achieving high durability.

Further, since the tension coil spring 233 is not extended more than needed to operate the pressure-releasing lever 231, the actuating force at operation is small, making user operation easy, and, in addition, the frictional force generated by the sliding contact between the tip-end side 231*b* of the pressure-releasing lever 231 and the inner surface of the cover 100 does not become too great, making it possible to prevent component wear. Furthermore, since the tension coil spring 233 returns to its natural length in a state in which the cover 100 is disengaged, and the pressure being applied to the pressure roller is released as shown in FIG. 2B, the respective parts do not have to be assembled in the biased state, making for good assemblability.

A user will open the cover 100 when a jam occurs, and in this embodiment, opening this cover 100 releases the fixing nip of the fixing device 22, thereby enabling the jammed paper to be easily removed.

Figure 3:
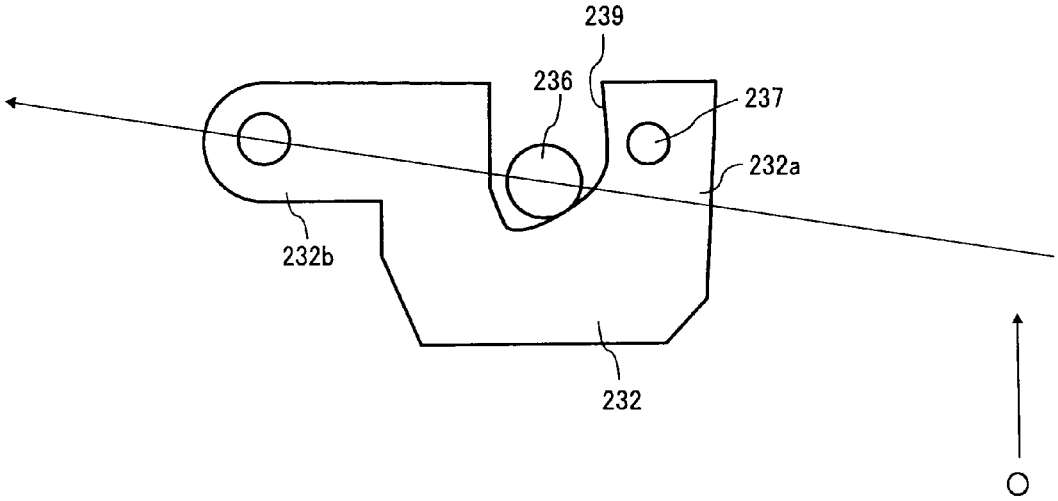
FIG. 3 is a diagram showing the physical relationship between the configuration of a locking member and a shaft in the embodiment.

FIG. 3 shows the physical relationship between the configuration of the locking member and the shafts. When the pressure-releasing lever 231 is in the pressure-applying position, if the shaft 237, which constitutes the hinge part of the locking member 232, is above an extension line O connecting the locking member other end 232*b*, which constitutes the hooking point of the tension coil spring 233, and the shaft 236, which constitutes the hinge part of the pressure-releasing lever 232 as in FIG. 3, the locking member 232 will attempt to rotate counterclockwise when pulled by the tension coil spring 233, but the locking member 232 is controlled by the shaft 236 and the locking member 232 position is maintained. When the pressure-releasing lever 231 is made to rotate to the press-releasing position, from the point in time when the shaft 237 of the locking member 232 rotates clockwise in FIG. 6 and falls below the extension line O, this shaft 237 continues to rotate as-is in the clockwise direction by virtue of the tensile force of the tension coil spring 233 until the tension coil spring 233 returns to its natural length. By configuring the present invention like this, the spring length is maintained at a determined position at all times, thereby enabling the pressure-applying force to be made constant.

If the pressure-applying force is too weak or too strong, the width of the fixing nip formed by the pressure-contact between the pressure roller 221 and fixing belt 224 will fluctuate, thereby giving rise to problems such as an insufficiently fixed image or over-fixed image, and the occurrence of cold offset or hot offset, but in this embodiment, it is possible to solve for problems such as these by combining the surface temperatures of the fixing members 221, 224.

Figure 4:
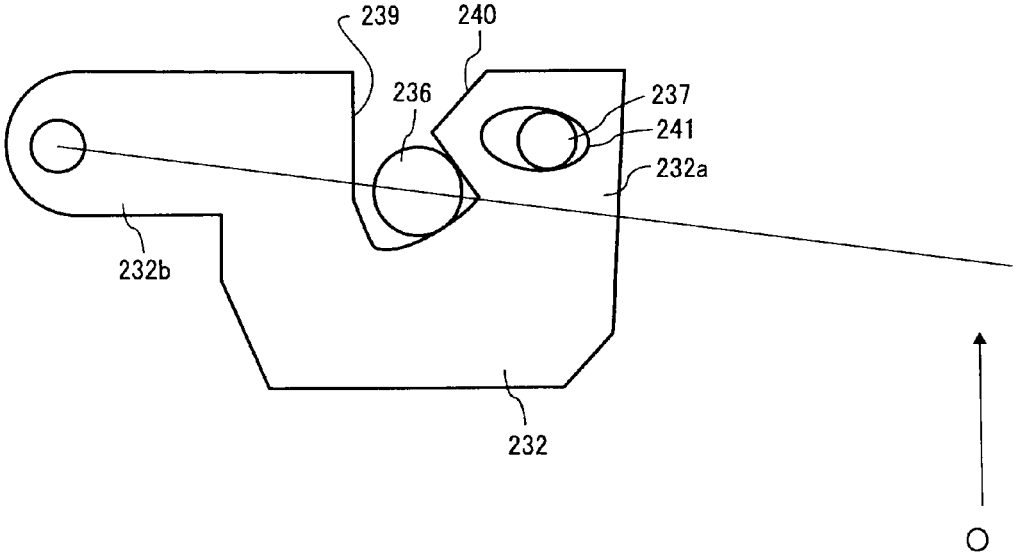
FIG. 4 is a diagram showing the physical relationship between the configuration of the same locking member on which a projection has been disposed and a shaft.

When the shaft 237 of the locking member 232 is in the vicinity of the extension line O, the operation of the pressure-releasing lever 231 will be insufficient and the pressure-releasing lever 231 will stop at a midway location, resulting in inappropriate pressure-applying force that is either too strong or too weak. FIG. 4 is an enlarged diagram showing the physical relationship between the configuration of a locking member 232 comprising a projection and the shafts. Accordingly, as shown in FIG. 4, the configuration is such that a projection 240 is disposed inside the concave part 239 of the locking member 232, and, in addition, an elongated hole 241, which loosely fits the shaft 237, is disposed in the one end 232*a* of the locking member 232 to allow the shaft 236 of the pressure-releasing lever 231 to ride over the projection 240 completely. When configured like this, the pressure-releasing lever 231 can be prevented from stopping at a halfway location, thereby making it possible to further stabilize the pressure-applying force.

Figure 5:
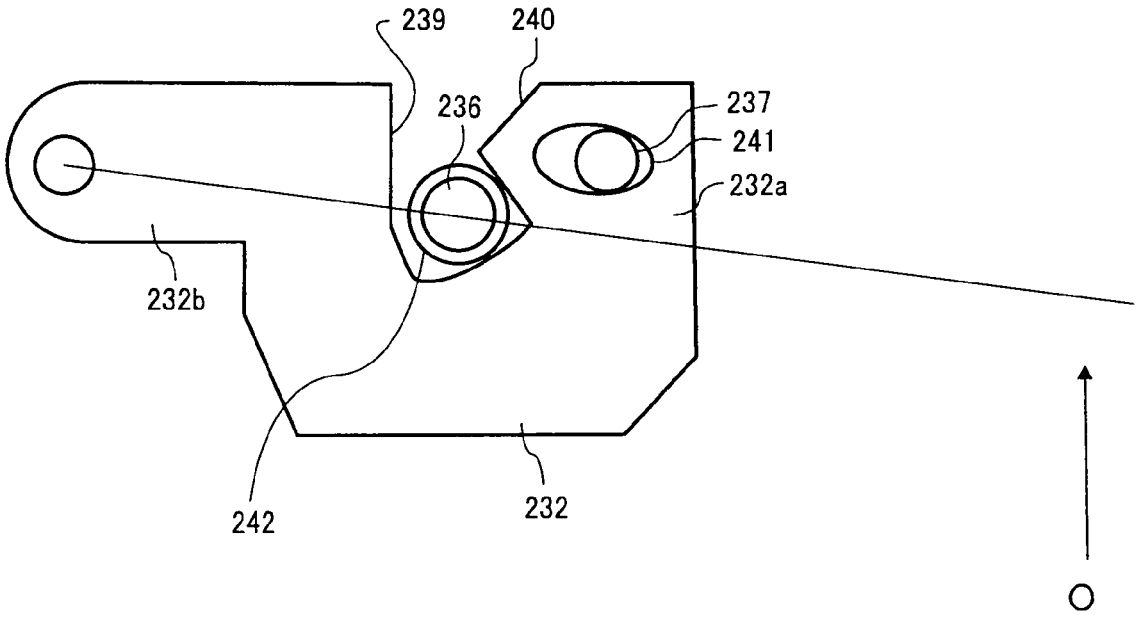
FIG. 5 is a diagram showing the physical relationship between the configuration of the same projection-disposed locking member and a shaft on which a bearing is disposed.

Since the shaft 236 of the pressure-releasing lever 231 slidingly contacts the projection 240 formed in the locking member 232 when riding over the projection 240, there is concern that the shaft 236 will be damaged over time by the wear on this part. FIG. 5 is an enlarged diagram showing the physical relationship between the configuration of a projection-equipped locking member and a shaft on which a bearing has been disposed. Thus, the shaft 236 does not enter directly into the concave part 239, but rather when a bearing 242 is disposed on the shaft 236 so that the projection 240 strikes the outside circumference of the bearing 242 as shown in FIG. 5, the projection 240 and bearing 242 rotate around each other without making sliding-contact, thereby eliminating wear and enhancing durability.

Figure 6:
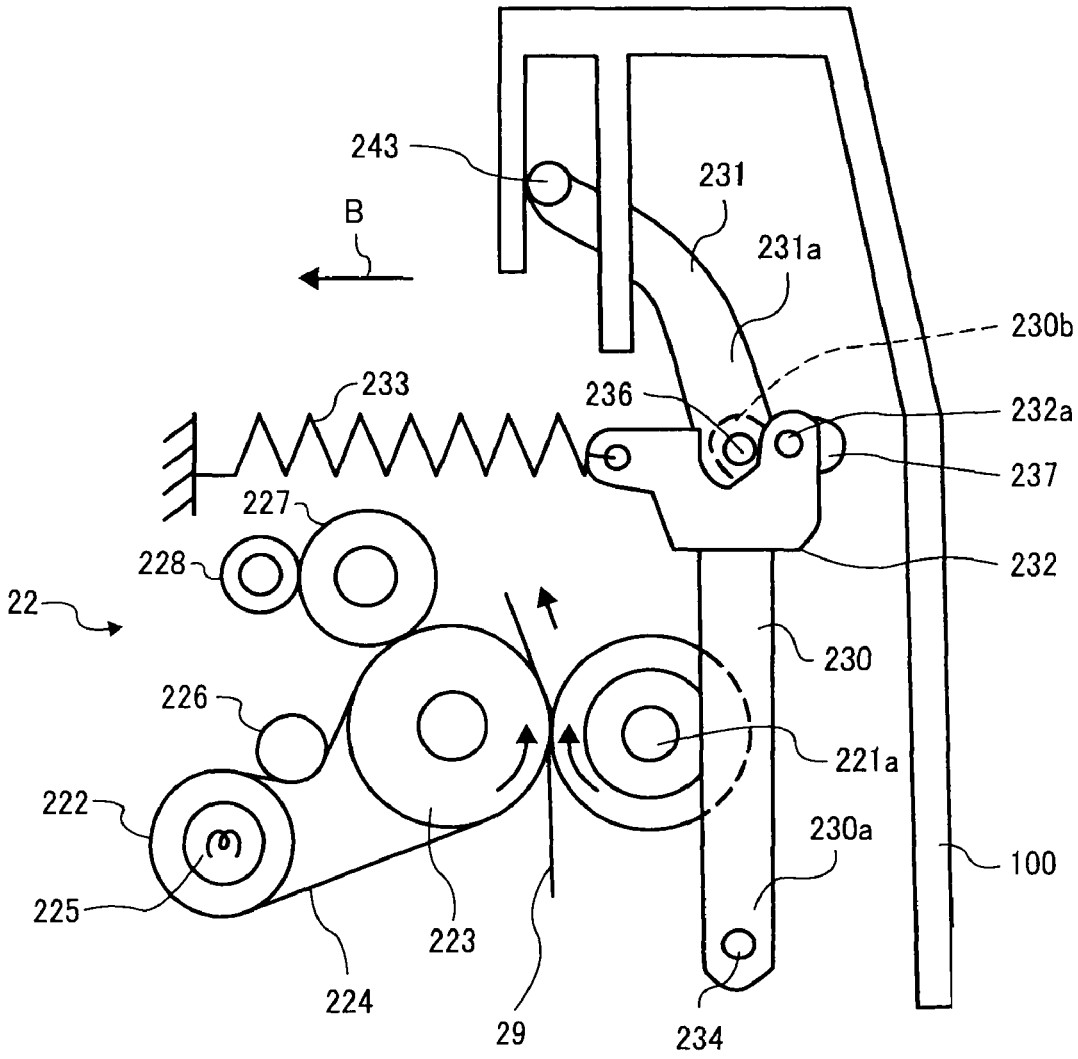
FIG. 6 is a diagram showing a modification of the embodiment in which a roller is disposed on a pressure-releasing lever.

FIG. 6 shows a modification in which a roller is disposed on the pressure-releasing lever. In FIGS. 2A and 2B, the tip-end side 231*b* of the pressure-releasing lever 231 makes direct contact with the inner surface of the cover 100, but, as shown in FIG. 6, frictional force can be reduced by disposing a roller 243 in a freely rotating manner on the tip-end side 231*b*, thereby making it possible to open and close the cover 100 with less force and to further enhance user operability.

Figure 7A:
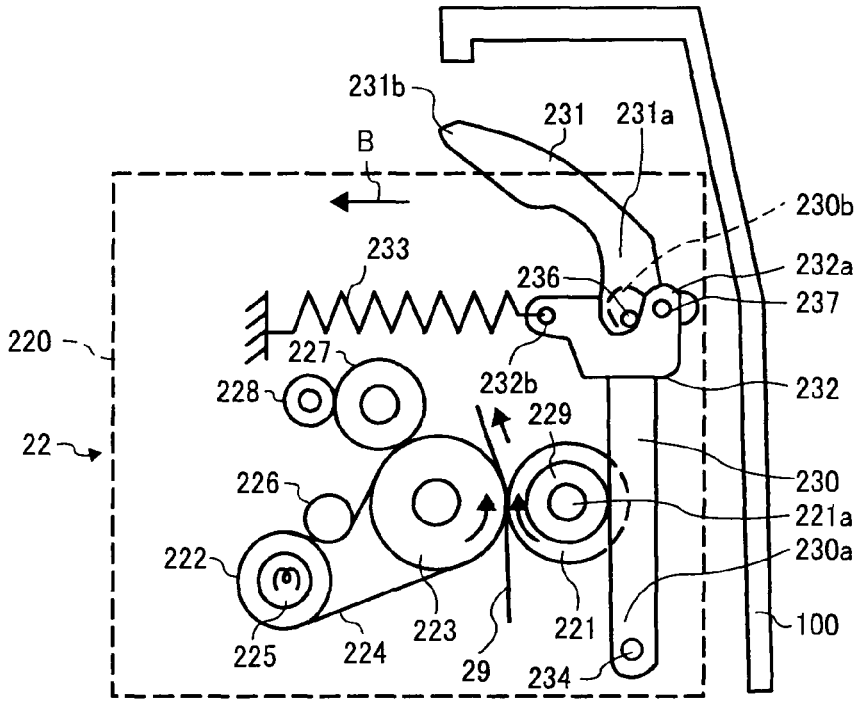
FIGS. 7A and 7B are diagrams showing the approximate configuration of another modification of the fixing device of the embodiment.
Figure 7B:
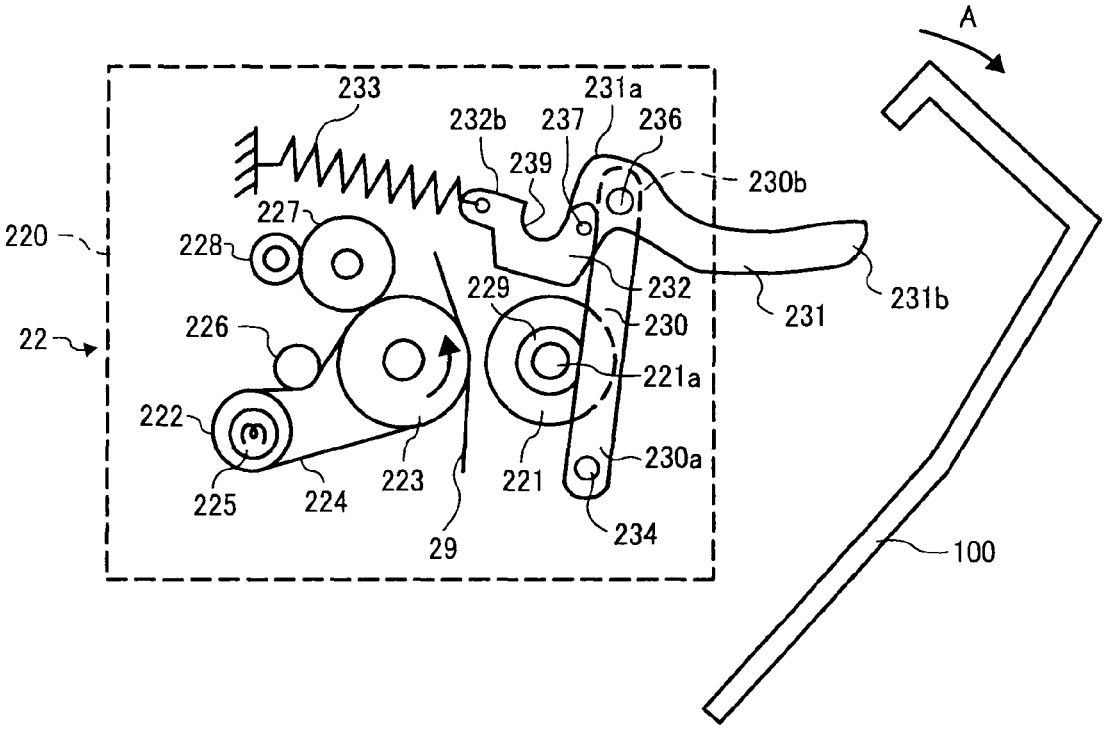

Further, FIGS. 7A and 7B show the configuration of another modification of the fixing device.

In this embodiment, the tip-end side 231*b* of the pressure-releasing lever 231 is engageably disposed on the cover 100, and the rotational operation thereof is synchronizably disposed with the opening-and-closing operations of the cover 100, but, as shown in FIGS. 7A and 7B, the configuration can also be such that the rotational operation of the tip-end side 231*b* of the pressure-releasing lever 231 is not synchronized to the opening and closing of the cover 100. In this case, as shown in the figure, the user directly operates the pressure-releasing lever 231 to make the one end thereof rotate, thereby switching over to the pressure-releasing mode so as to enable operation of the pressure-applying lever 230 that changes the pressing and gripping pressure. Furthermore, the one end of the pressure-releasing lever 231 can protrude outside of the fixing device enclosure 220. The pressure-applying lever 230 can be easily controlled from the outside of the fixing device 22.

Next, varying the gripping pressure on a piece of paper 29 using the pair of fixing members 221, 224 will be explained. This embodiment has an elastic member 233, which is latched to the other end of the locking member 232 and pulls the locking member 232 in the locking direction B, and rotating the pressure-releasing lever 231 releases the pressing pressure of the pressure-applying lever 230 and changes the gripping pressure by making it possible to select the location of the support point of the pressure-applying lever 230 that uses the pair of fixing members 221, 224 to grip the piece of paper 29. The configuration at this time is such that it is possible to switch from a pressure-applying position, in which the one fixing member 221 presses against the other fixing member 224 via the pressure-applying lever 230, to the pressure-releasing position, in which the one fixing member 221 moves away from the other fixing member 224, and in the pressure-applying position, the pressure-applying lever 230 and the locking member 232, which are fastened together at a location of the end of the pressure-applying lever 230 opposite that of the rotational central shaft, are pulled in the locking direction B by the elastic member 233. In the pressure-releasing position, the pressing force of the pressure-applying lever 230 is released, and the gripping pressure is changed at this time using through-holes 251, 252.

Figure 8:
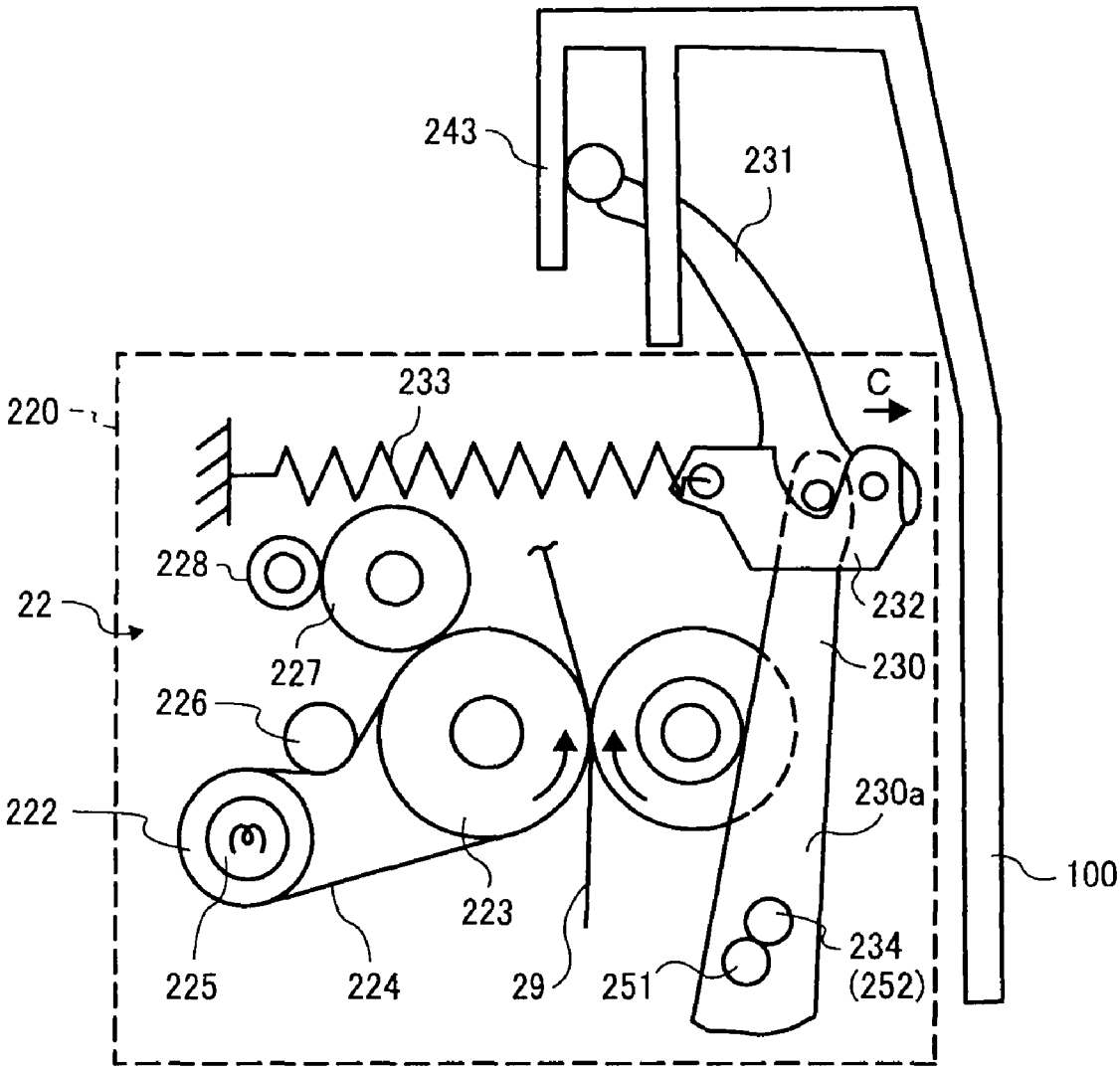
FIG. 8 is a diagram showing the approximate configuration of another modification of the embodiment.
Figure 9C:
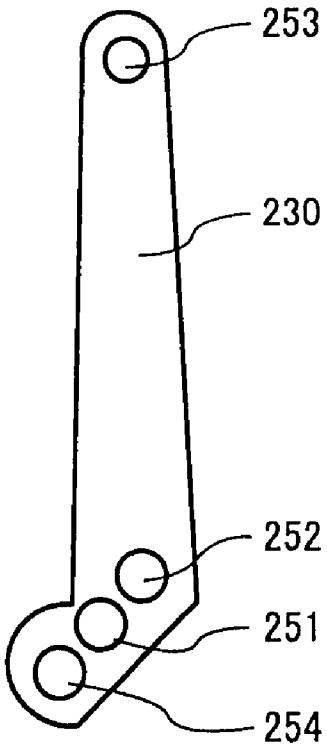
FIGS. 9A through 9C are diagrams showing the configurations of a pressure-applying lever related to another modification of the embodiment.

FIG. 8 shows the configuration of another modification of the fixing device. Further, FIG. 9 shows the shapes of the pressure-applying lever. The fixing device 22 of this modification is practically the same configuration and shape as the fixing device 22 of heretofore, and as such, a detailed explanation will be omitted.

Figure 9B:
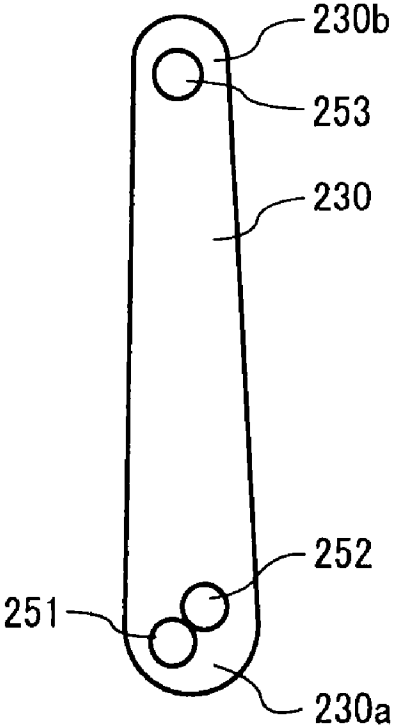
Figure 9A:
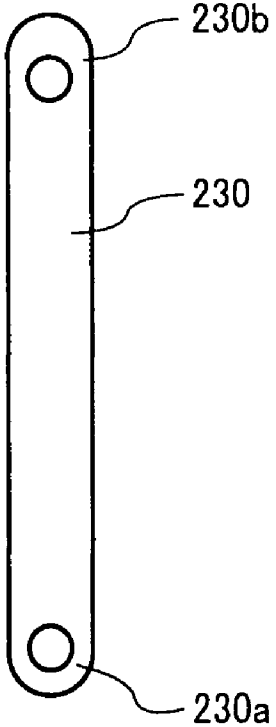

FIG. 9B shows a pressure-applying lever 230 that can vary the gripping pressure on the paper 29. A through-hole 250, which allows the rotating central shaft to pivot, is disposed in the one end 230*a* of the pressure-applying lever 230, but in addition to through-hole 251, the physical relationship of which is identical to the through-hole of the pressure-applying lever 230, the pressure-applying lever 230 has a through-hole 252, which is closer in distance to a through-hole 253 in the other end 230*b* of the pressure-applying lever 230 than through-hole 251, disposed 450 above and to the right of through-hole 251. FIG. 8 shows a fixing device 22 that makes use of the pressure-applying lever 230. If through-hole 251 is the one allowing the rotating central shaft 234 to pivot, the gripping pressure on the paper 29 is the same as when the pressure-applying lever 230 is used, but when through-hole 252 is the one allowing the rotating central shaft 234 to pivot, the physical relationship of the pressure-applying lever 230 to the pressure roller 221 changes and the locking member 232 shifts in the direction of arrow C, thereby resulting in the tension coil spring 233 being maintained in a more extended state. Consequently, the gripping pressure on the paper 29 is also maintained at a stronger level. Maintaining the gripping pressure on the paper 29 at a stronger level results in better fixability for the toner image on the paper 29, and, in addition, enables better control of glossiness. Furthermore, when the paper 29 is thick and pressure is to be increased further, making the pressure-applying lever 230 bigger and enlarging the through-hole 252 enables the gripping pressure on the paper 29 to be made stronger.

By contrast, maintaining the gripping pressure on the paper 29 at a weaker level makes it possible to enhance paper adaptability. For example, when fixing is done on special paper 29, such as an envelope or the like, the paper 29 can become wrinkled if the gripping pressure on the paper 29 is high. In a case like this, if the configuration disposes a through-hole 254 in a location that weakens the gripping pressure on the paper 29 and also allows the rotating central shaft 234 to pivot, like the through-hole 254 of the pressure-applying lever 230 disclosed in FIG. 9C, wrinkles and other such problems do not occur, making it possible to fix the toner. When fixability is reduced in line with the lowering of the nip pressure force, adjusting the control temperatures of the fixing members 221, 224 to the optimum value makes it possible to maintain good fixability. Furthermore, the alternative to equipping the pressure-applying lever 230 disclosed in FIG. 9C with through-hole 254 is the same configuration as the pressure-applying lever 230 disclosed in FIG. 9B.

Once the toner used in image-forming apparatus 1 has been applied, it is very difficult to make changes. Further, with regard to the toner, the temperature of the fixing members 221, 224 is controlled within a range that does not result in defective fixing or hot offset. Thus, changing the temperature of the fixing members 221, 224 during image formation is apt to cause image smudging resulting from defective fixing or hot offset. In this respect, image smudging can be curbed and toner fixability controlled by changing the pressure and controlling the fixing conditions without changing the temperature of the fixing members 221, 224.

Figure 10:
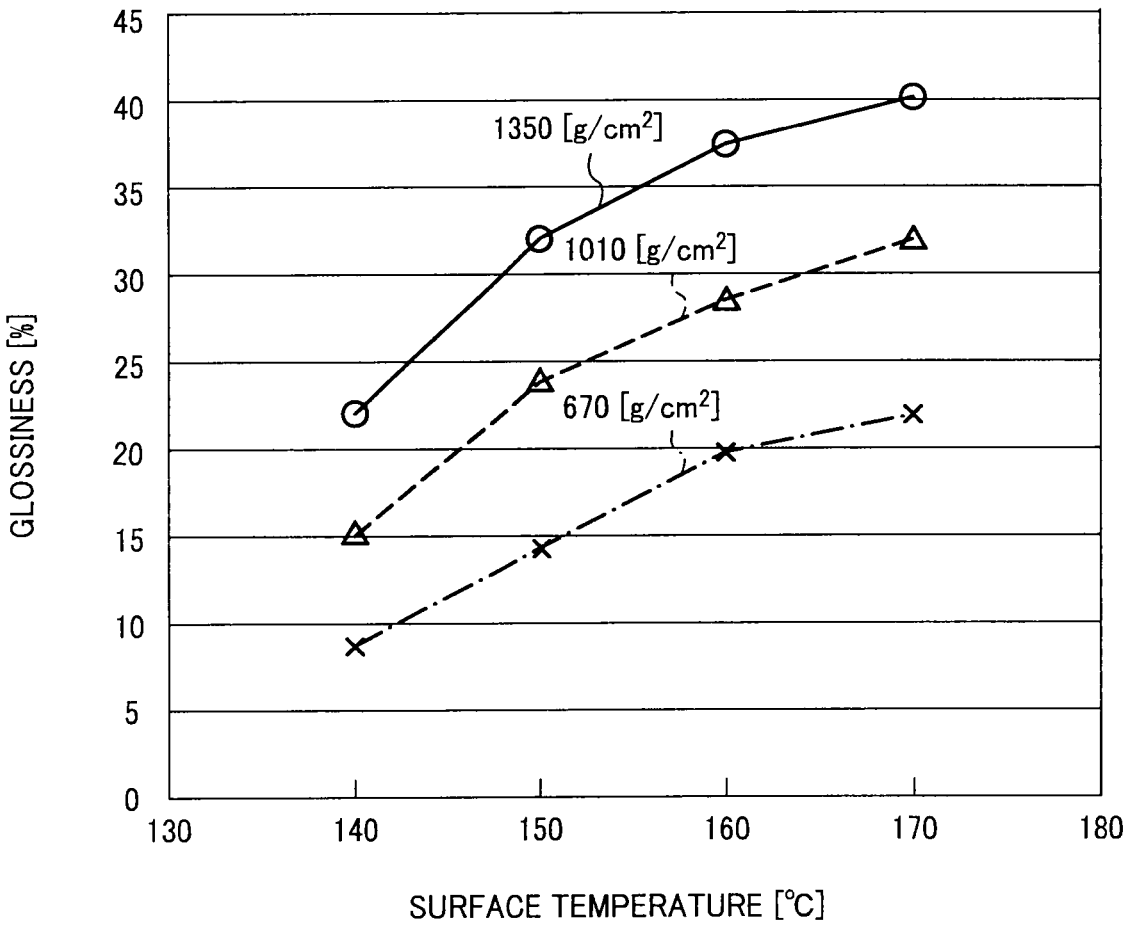
FIG. 10 is a graph showing the relationship between the surface temperature of the fixing member and glossiness when the gripping pressure on the recording medium in the embodiment has been changed.

FIG. 10 is a graph showing the relationship between the surface temperature of the fixing member and glossiness when the gripping pressure on the paper 29 has been changed. The standard surface pressure of the fixing device is 1010 [g/cm$^2$], but it is known that glossiness is raised by raising the surface pressure to 1350 [g/cm$^2$], and, by contrast, that glossiness is lowered by lowering the surface pressure to 670 [g/cm$^2$]. Since this surface pressure value is device specific, and changes in accordance with the characteristics of the toner that is being used, the center value and variation range thereof should be set in accordance with the device and toner to be used. The location of the through-holes 251, 252, 254 should also be determined in accordance with the device to be used and the desired surface pressure. Furthermore, in this embodiment, glossiness was measured using the Minolta GM-60 Glossmeter (measurement angle=60°).

Furthermore, for the toner used in this embodiment, when fixing was carried out with the surface temperature of the fixing member ranging between 140 and 170°, there was no abnormal imaging resulting from defective fixing or hot offset.

Figure 11A:
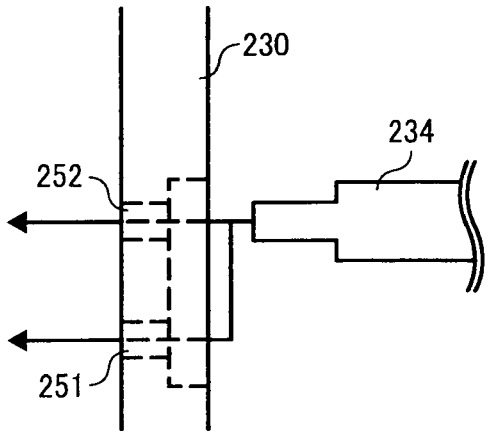
FIGS. 11A through 11C are diagrams for illustrating changes in the through-hole of the pressure-applying lever used in the fixing device of the embodiment.
Figure 11B:
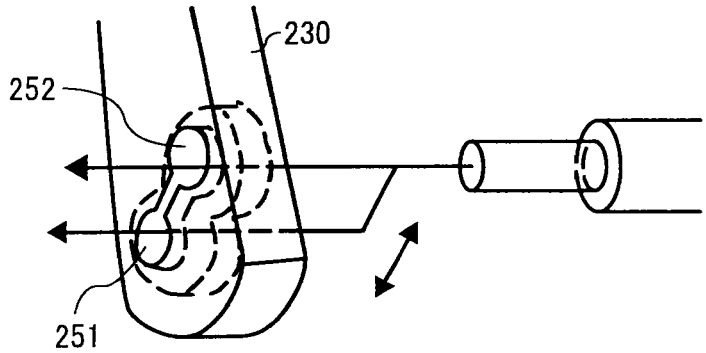
Figure 11C:
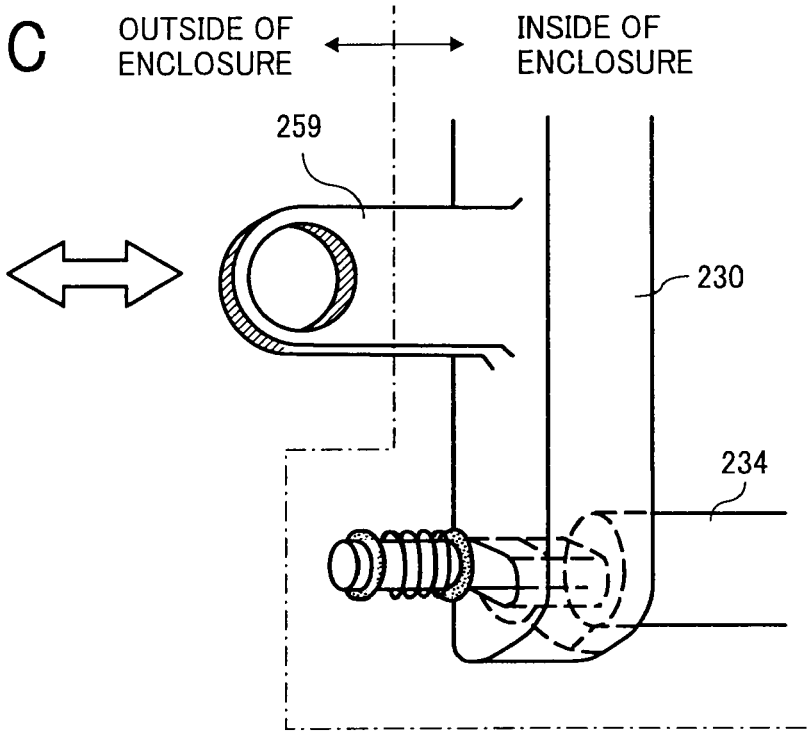

Next, referring to FIGS. 11A through 11C of the drawings, changing the through-holes of the pressure-applying lever utilized in the fixing device of this embodiment will be explained. In the pressure-applying levers 230 shown in FIGS. 9B and 9C, the pressure force of the fixing device 22 and toner fixing are controlled by changing the through-holes 251, 252. For example, as shown in FIG. 11A the through-holes 251, 252 are formed in a staircase pattern in the pressure-applying lever 230, and, in addition, the tip of the rotating central shaft 234 features a stepped configuration, and a procedure for changing the position of the rotating central shaft 234 by making it engage with the desired through-hole 251, 252 can be used at this time. In this procedure, when fixing the position of the rotating central shaft 234, the shaft 234 is made to engage with a through-hole, and when changing the position of the rotating central shaft 234, the shaft 234 is made to disengage from the through-hole by sliding in the direction of thrust of the shaft, and, subsequent to moving in the vertical direction (or horizontal direction), once again moving in the thrust direction.

Consequently, it is possible to provide a fixing device in which the desired glossiness is achieved using a simple configuration, and, in addition, adaptability with regard to paper 29 is high.

Further, in FIG. 1C, the pressure-applying lever 230 comprises a lug 259. Since the fixing device 22 has a part that is heated to a high temperature, except for the part that would obstruct the transport of the paper 29, the fixing device 22 is covered by a fixing device enclosure 220, but the lug 259 protrudes outside the fixing device enclosure 220 to a part that the user is able to touch/adjust. At this time, the lug 259 can protrude not only outside of the fixing device enclosure 220, but also outside the image-forming apparatus 1 to a user touchable/adjustable part. Naturally, the lug 259 can also be configured such that a raising process can be carried out without the user getting burned.

Drawing the lug 259 outside the fixing device enclosure 220 makes it possible to set the rotating central shaft 234 in a through-hole 251, 252, 254, which can be adjusted as desired, by disengaging the rotating central shaft 234 and the pressure-applying lever 230 of the fixing members 221, 224, and shifting the rotating central shaft 234 in the radial direction, consequently making it possible to change the nip between the fixing members 221, 224 to the desired pressure.

Figure 12A:
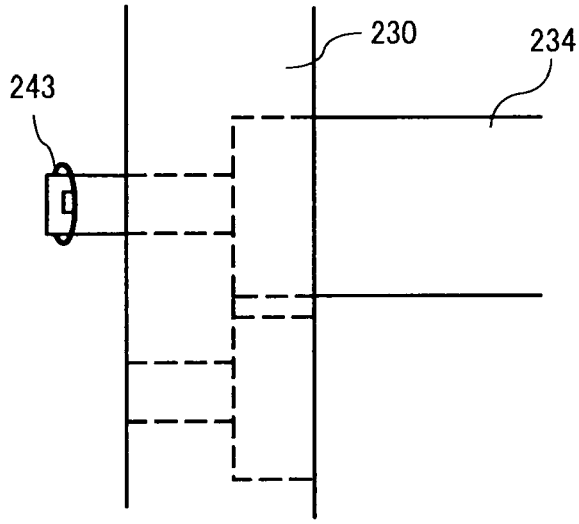
FIGS. 12A and 12B are diagrams showing configurations for keeping the rotating central shaft of the pressure-applying lever used in the fixing device of the embodiment from coming out of the through-hole.
Figure 12B:
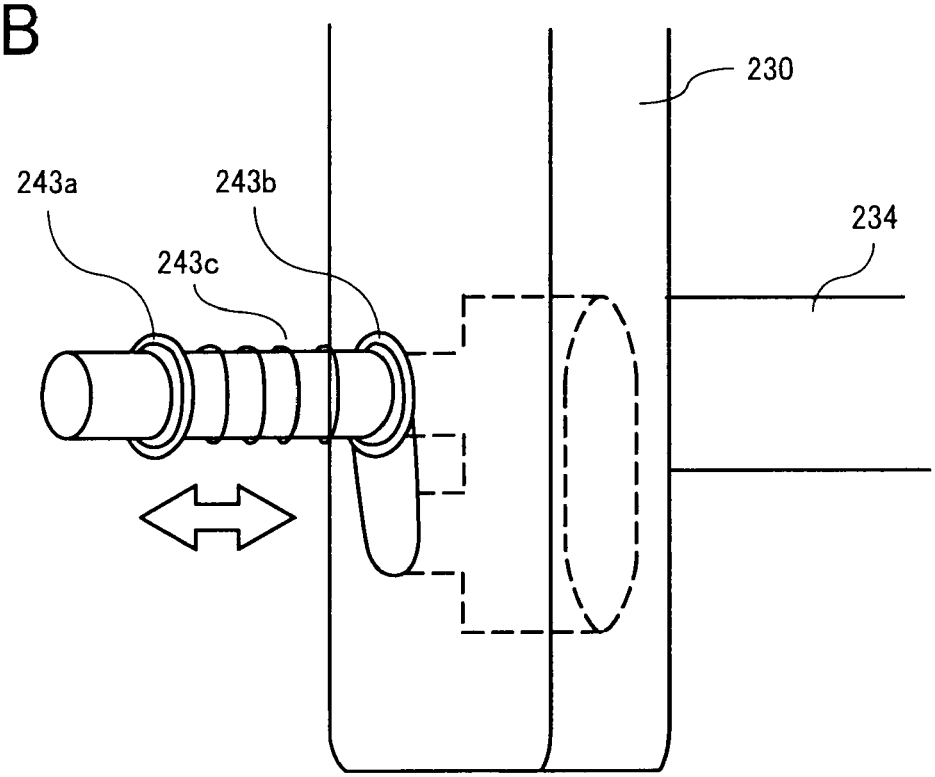

FIGS. 12A and 12B show configurations that suppress the separation of the rotating central shaft from the through-hole of the pressure-applying lever used in the fixing device of this embodiment. To prevent the shaft from slipping out of the through-hole, subsequent to assembling the pressure-applying lever 230 and rotating central shaft 234 as shown in FIG. 12A, unseating can be prevented by disposing a retaining E-ring 243 on the end of the shaft.

Further, as shown in FIG. 12B, two retaining rings (243*a*, 243*b*) provided with a space therebetween on the rotating central shaft 234 on the outer side of the pressure-applying lever 230, and an extensible spring 243*c* is disposed between the two. Consequently, since the pressure-applying lever 230 can move in the thrust direction of the shaft 234, and, in addition, the pressure-applying lever 230, which moves after a setting change, is pushed by the spring 243*c* on the shaft 234 from the outside, it is possible to prevent problems such as the pressure-applying lever 230 being maintained in a defective setting state.

Next, in the fixing device 22 of this embodiment, one of the pair of fixing members 221, 224 is configured to be pressed by the pressure-applying lever 230 in the gripping direction of the paper 29, and the pressure-applying position of the above-mentioned pressed fixing member 221 and the pressure-applying lever 230 can be selected. Whereas, in the embodiments described hereinabove, the gripping pressure on the paper 29 was varied by changing the support-point location of the pressure-applying lever 230, the gripping pressure on the paper 29 is changed here by changing the pressure-applying position of the pressure-applying lever 230 relative to the pressed fixing member 221.

Figure 13A:
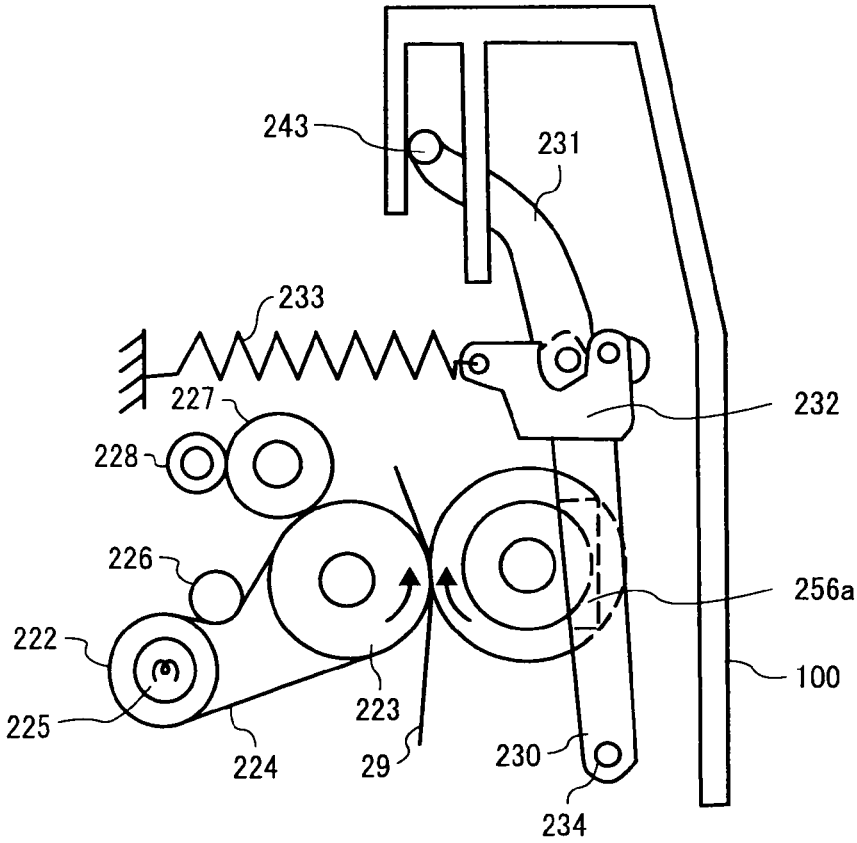
FIGS. 13A, 13B, 14A, 14B, 15, 16A and 16B are diagrams showing the approximate configurations of fixing devices related to other respective modifications of the embodiment.
Figure 13B:
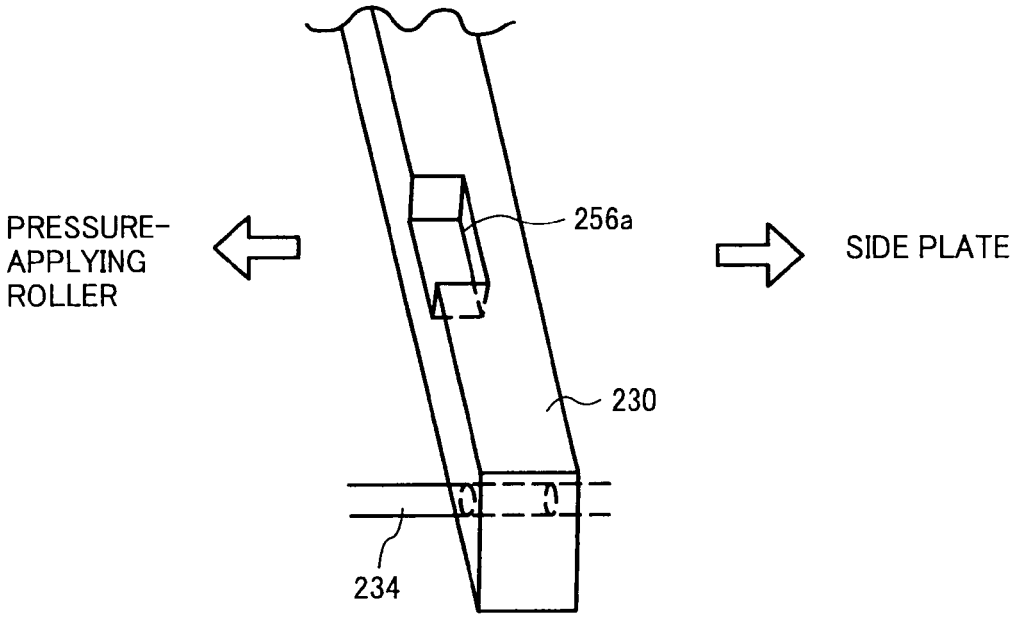

FIGS. 13A and 13B show the configuration of another modification of the fixing device. FIG. 13A is an example of pressure-applying lever 230 that can vary the gripping pressure on the paper 29 by changing the pressure-applying position of the pressure-applying lever 230. A concave notch 256*a* is disposed on the pressure-applying lever 230 on the side of the bearing 229 provided at the end part of the metal core 221*a* of the pressure roller 221. Adjusting the pressure-applying lever 230 in the direction of thrust of the pressure roller 221 changes the pressure-applying positions of the bearing 229 and the pressure-applying lever 230 by the size of the concave notch 256*a* as shown in FIG. 13B, the elastic member 233 is extended in line with this, and the length of the elastic member 233 in the fixed state becomes shorter, lessening the gripping pressure on the paper 29.

Figure 14A:
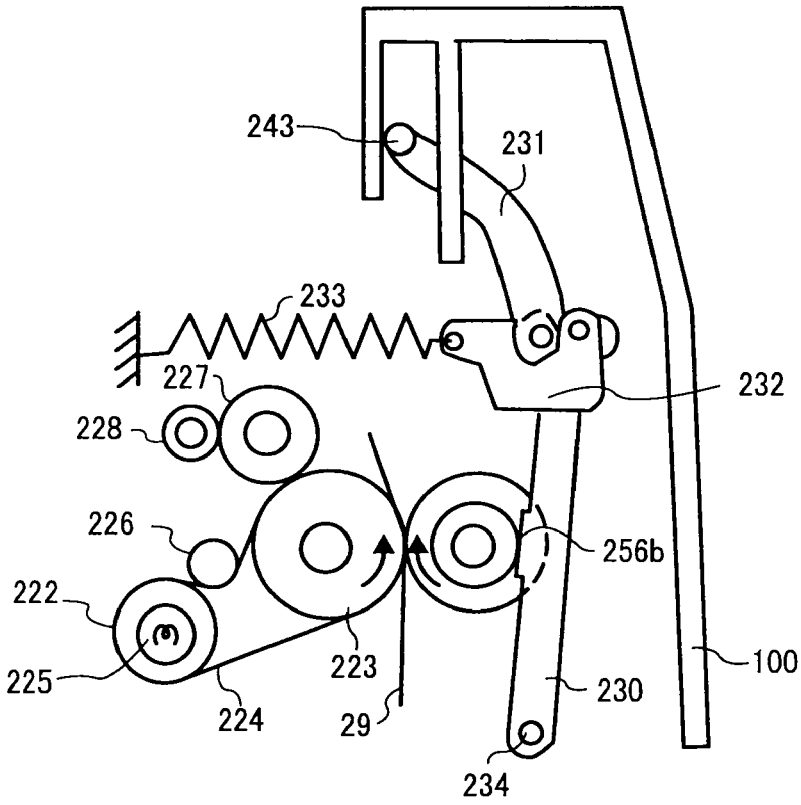
Figure 14B:
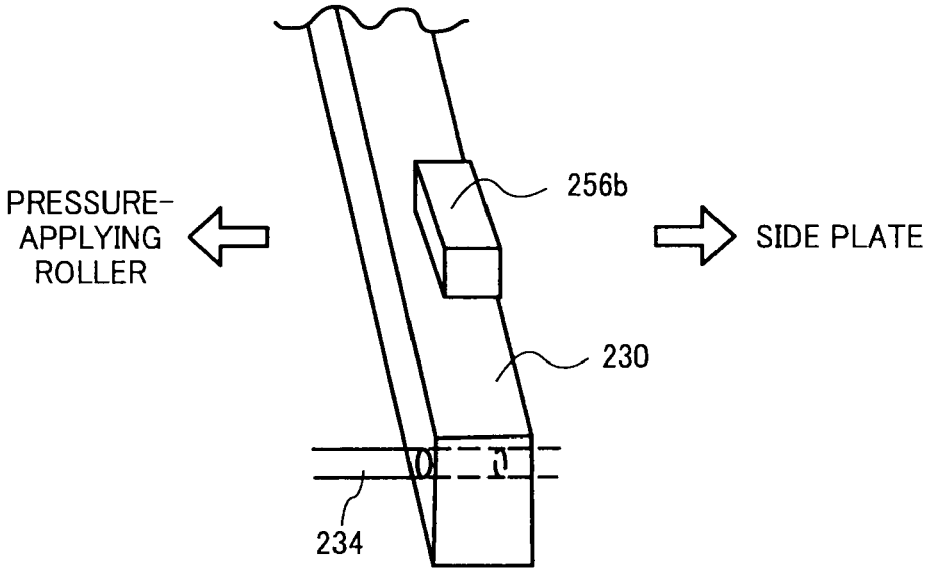

FIGS. 14A and 14B shows the configuration of another modification of the fixing device. By contrast, as shown in FIG. 14A, adjusting the pressure-applying lever 230, to which a convex projection 256*b* has been disposed on the opposite side of the bearing 229 provided at the end part of the metal core 221*a* of the pressure roller, in the direction of thrust of the pressure roller 221 changes the pressure-applying position of the bearing 229 and the pressure-applying lever 230 by the size of the convex projection 256*b* as shown in FIG. 14B, the elastic member 233 is extended in line with this, and the length of the elastic member 233 in the fixed state becomes longer, making it possible to increase the gripping pressure on the paper 29.

In accordance with the above, it is possible to provide a fixing device 22 in which the desired glossiness is achieved via a simple configuration, and, in addition, paper adaptability is high. In particular, using the convex projection 256*b* to maintain stronger gripping pressure on the paper 29 improves the fixability of the toner image on the paper 29, and makes it possible to better control glossiness. Furthermore, when the paper 29 is thick, disposing the convex projection 256*b* in a step-like fashion increases the movement of the pressure-applying lever 230, making it possible to further strengthen the gripping pressure on the paper 29.

By contrast, maintaining the gripping pressure on the paper 29 at a weaker level also makes in possible to enhance paper adaptability. For example, when carrying out fixing on specialized paper 29, such as an envelope or the like, if the gripping pressure on the paper 29 is high, the paper 29 can become wrinkled. In a case like this, weakening the gripping pressure on the paper 29 as with a pressure-applying lever 230 that has a concave notch 256*a* makes it possible to fix the toner without generating wrinkles or other such problems.

Figure 15:
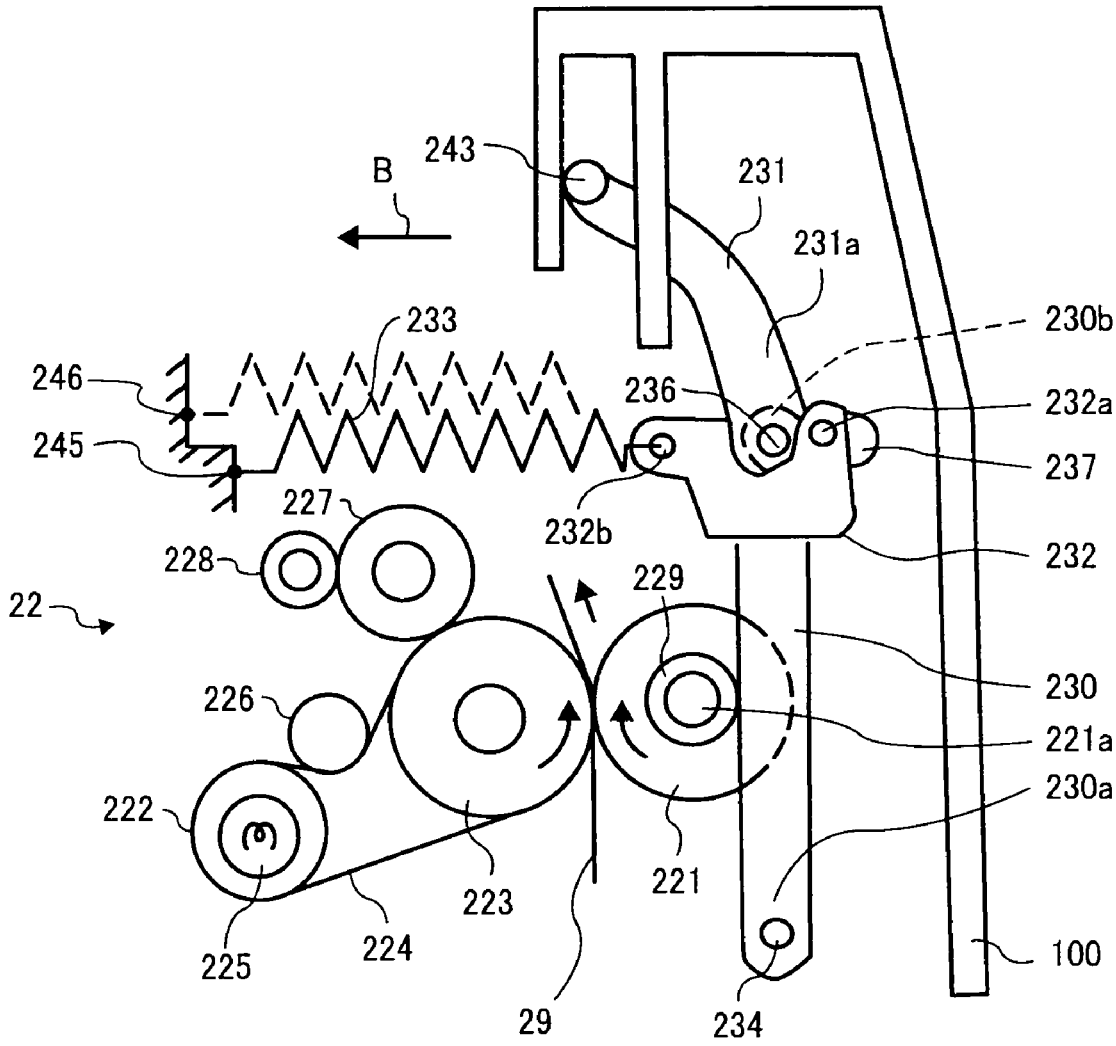

FIG. 15 shows the configuration of another modification of the fixing device. In this fixing device, the support location of the elastic member changes. As shown in FIG. 15, the configuration is such that it is possible to select between a default location 245 and an extended location 246 as the support point of the elastic member 233 on the main body side. Consequently, when the elastic member 233 is fixed in the extended state, the length of the elastic member 233 in the extended location 246 is longer than that in the ordinary default location 245, making it possible to increase the gripping pressure on the paper 29. By contrast, if a location in which the elastic member 233 is in more of a contracted state than in the default location 245 is selected and fixed as the main body side support point, the length of the elastic member 233 becomes shorter, making it possible to reduce the gripping pressure on the paper 29. Therefore, in this embodiment, the gripping pressure on the paper 29 can be changed in the same way by changing not only the location from which the pressure-applying lever 230 applies pressure to the fixing member, but also the location of the elastic member that pulls the pressure-applying lever 230, which is fixed at a location at the opposite end from the rotating central shaft of the pressure-applying lever 230, in the locking direction. In particular, because changing the gripping pressure resulting from the elastic member makes possible a change that is completely separate from the control of the pressure-applying lever 230, the pressure can be changed in multiple steps. In accordance with the above, it becomes possible to provide a fixing device in which the desired glossiness is achieved via a simple configuration, and, in addition, paper adaptability is high.

Figure 16A:
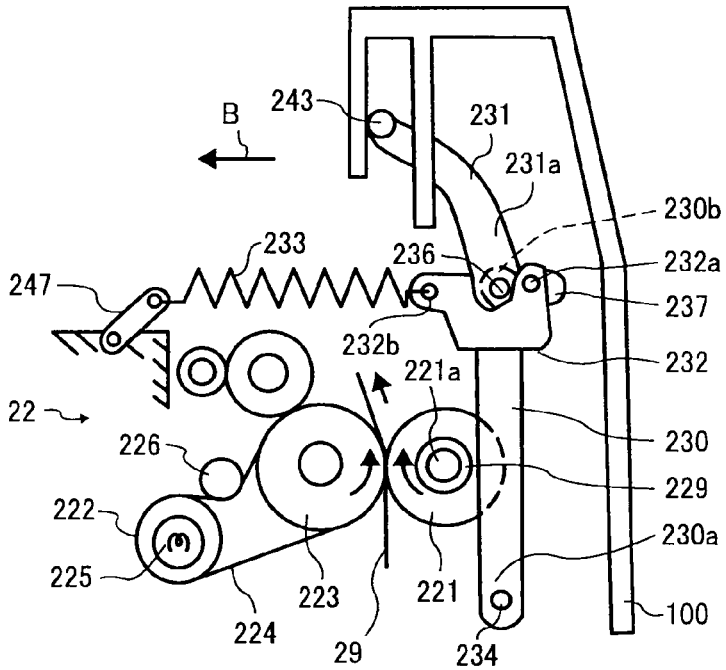
Figure 16B:
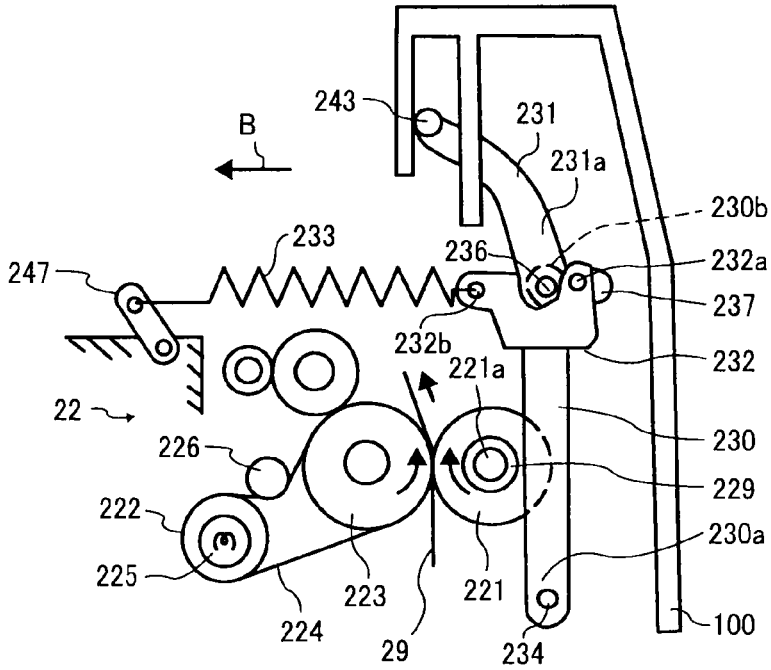

FIGS. 16A and 16B show the configuration of another modification of the fixing device. In this fixing device, the location for supporting the elastic member is changed using an elastic body variable support member 247. Since it is not easy to change the main body side support points 245, 246 by manipulating a spring, which is the elastic member 233, this can also make it difficult to change the pressure. Accordingly, as shown in FIGS. 16A and 16B, this modification comprises an elastic body variable support member 247 that makes it possible to change to a desired nip pressure. The elastic body variable support member 247, as shown in FIG. 16B, is capable of rotating, and causing this member 247 to rotate changes the location of the elastic member 233, and moving away enables an adjustment to be made such that the distance of the elastic member 233 from the pressure-applying lever 230 becomes longer, making it possible to increase the gripping pressure. Further, rotating the elastic body variable support member 247 makes it possible to adjust the length of the elastic member 233 from the pressure-applying lever 230, and the gripping pressure on the paper 29 can be adjusted to the lower side in the same way. Consequently, it becomes possible to provide an image-forming apparatus 1 comprising a fixing device in which the desired glossiness is continuously achieved, and, in addition, paper adaptability is high.

As has been explained hereinabove, according to the fixing device and image-forming apparatus of the present invention, it is possible to provide a fixing device and image-forming apparatus, which have simple configurations, achieve the desired glossiness by allowing the user himself to easily change the fixability of the fixing device, and are highly adaptable to different types of recording media.

Various modifications will become possible for those skilled in the art after receiving the teachings of the present disclosure without departing from the scope thereof.

What is claimed is:

1. A fixing device, which uses a pair of opposing fixing members to grip a recording medium, and which fixes a toner image onto the recording medium by applying heat and/or pressure, the fixing device comprising:

a pressure-applying lever which rotates about a support, the pressure-applying lever for causing one of the pair of fixing members to apply pressure to the other one of the pair of fixing members;

a pressure-releasing lever that is rotationally supported on the pressure-applying lever;

a locking member, which has one end rotationally attached to the pressure-releasing lever; and an elastic member, which engages with the other end of the locking member, and which pulls the locking member in a locking direction, wherein the rotation of the pressure-releasing lever displaces the location of the locking member, thereby enabling switching between a pressure-applying position, in which one of the pair of fixing members presses against the other one of the pair of fixing members via the pressure-applying lever, and a pressure-releasing position, in which one of the pair of fixing members moves away from the other one of the pair of fixing members, at the pressure-applying position, the pressure-applying lever and the locking member, which are fastened together at a location at one end of the pressure-applying lever opposite the support, are pulled in the locking direction by the elastic member, and the pressure-applying lever has multiple support positions about which the pressure-applying lever can rotate, such that different non-zero pressures for gripping the recording medium between the pair of fixing members are applied when the pressure releasing lever is in the pressure-applying position depending on which of the multiple support positions are used.

2. The fixing device according to claim 1, wherein the fixing device varies the gripping pressure on the recording medium by the pair of fixing members by moving the elastic member.

3. The fixing device according to claim 1, wherein a pressure roller, which constitutes one of the pair of opposing fixing members, and a fixing belt, which is a belt member suspended around a pair of rollers, and which constitutes the other one of the pair of fixing members, face one another.

4. The fixing device according to claim 1, wherein a surface temperature of the fixing members is changed by varying the gripping pressure on the recording medium by the pair of fixing members.

5. An image forming apparatus including a fixing device, the fixing device comprising:

a pair of opposing fixing members to grip a recording medium, and which fixes a toner image onto the recording medium by applying heat and/or pressure;

a pressure-applying lever which rotates about a support, the pressure-applying lever for causing one of the pair of fixing members to apply pressure to the other one of the pair of fixing members;

a pressure-releasing lever that is rotationally supported on the pressure-applying lever;

a locking member rotationally attached to the pressure-releasing lever and displaced by the rotation of the pressure releasing lever so that the locking member is moved between a pressuring-applying position and a pressure-releasing position; and an elastic member, which engages with the locking member, and which pulls the locking member in a direction, wherein the elastic member forces the one of the pair of fixing members to apply more pressure to the other one of the pair of fixing members at the pressure-applying position than at the pressure-releasing position, and the pressure-applying lever has multiple support positions about which the pressure-applying lever can rotate, such that different non-zero pressures for gripping the recording medium between the pair of fixing members are applied when the pressure releasing lever is in the pressure-applying position depending on which of the multiple support positions is used.

6. The fixing device according to claim 5, wherein the fixing device varies the gripping pressure on the recording medium by the pair of fixing members by moving the elastic member.

7. The fixing device according to claim 5, wherein a pressure roller, which constitutes one of the pair of opposing fixing members, and a fixing belt, which is a belt member suspended around a roller, which constitutes the other one of the pair of fixing members, face one another.

8. The fixing device according to claim 5, wherein a surface temperature of the fixing members is changed by varying the gripping pressure on the recording medium by the pair of fixing members.

9. An image-forming apparatus comprising:

an image carrier for forming a latent image;

a charging device for applying a uniform electrical charge to a surface of the image carrier;

an exposure device for exposing and writing a latent image to the charged surface of the image carrier based on image data;

a developing device for supplying toner to the latent image formed on the surface of the image carrier to make this image visible;

a cleaning device for bringing a blade into contact with the surface of the image carrier to remove residual toner;

a transfer device for transferring the visible image on the surface of the image carrier to a recording medium either directly or after having transferred this image to an intermediate transfer body; and a fixing device, which uses a pair of opposing fixing members to grip the recording medium, and which fixes a toner image onto the recording medium by applying heat and/or pressure, the fixing device comprising:

a pressure-applying lever which rotates about a support, the pressure-applying lever for causing one of the pair of fixing members to apply pressure to the other one of the pair of fixing members;

a pressure-releasing lever that is rotationally supported on the pressure-applying lever;

a locking member, which has one end rotationally attached to the pressure-releasing lever; and an elastic member, which engages with the other end of the locking member, and which pulls the locking member in a locking direction, wherein the rotation of the pressure-releasing lever displaces the location of the locking member, thereby enabling switching between a pressure-applying position, in which one of the pair of fixing members presses against the other one of the pair of fixing members via the pressure-applying lever, and a pressure-releasing position, in which one of the pair of fixing members moves away from the other one of the pair of fixing members, at the pressure-applying position, the pressure-applying lever and the locking member, which are fastened together at a location at one end of the pressure-applying lever opposite the support, are pulled in the locking direction by the elastic member, the pressure-applying lever has multiple support positions about which the pressure-applying lever can rotate, such that different non-zero pressures for gripping the recording medium between the pair of fixing members are applied when the pressure releasing lever is in the pressure-applying position depending on which of the multiple support positions is used, and a cover, which is supported on a main body of the image-forming apparatus is engaged with one end of the pressure-releasing lever in a freely opening and closing manner, thereby causing the pressure-releasing lever to rotate as the result of the opening and closing operation of the cover.

* * * * *